US006170567B1

(12) United States Patent
Nakada et al.

(10) Patent No.: US 6,170,567 B1
(45) Date of Patent: Jan. 9, 2001

(54) HEAT EXCHANGER

(75) Inventors: Keiichi Nakada; Toshiaki Muramatsu; Kaoru Hasegawa, all of Tochigi (JP)

(73) Assignee: Showa Aluminum Corporation, Sakai (JP)

( * ) Notice: Under 35 U.S.C. 154(b), the term of this patent shall be extended for 0 days.

(21) Appl. No.: 09/319,320

(22) PCT Filed: Dec. 5, 1997

(86) PCT No.: PCT/JP97/04465

§ 371 Date: Jun. 4, 1999

§ 102(e) Date: Jun. 4, 1999

(87) PCT Pub. No.: WO98/25093

PCT Pub. Date: Jun. 11, 1998

(30) Foreign Application Priority Data

Dec. 5, 1996 (JP) ..... 8-325195
Mar. 31, 1997 (JP) ..... 9-080314

(51) Int. Cl.[7] ..... F28D 1/02; F28D 7/06; F28F 9/02

(52) U.S. Cl. ..... 165/153; 165/175; 165/176

(58) Field of Search ..... 165/153, 175, 165/176, 76

(56) References Cited

U.S. PATENT DOCUMENTS

| | | | | |
|---|---|---|---|---|
| 3,017,161 | | 1/1962 | Slaasted et al. . | |
| 3,670,812 | * | 6/1972 | Bemrose | 165/175 |
| 3,805,889 | | 4/1974 | Coolidge . | |
| 4,258,785 | * | 3/1981 | Beldam | 165/175 |
| 4,379,486 | | 4/1983 | Kurihara . | |
| 4,846,268 | * | 7/1989 | Beldam et al. | 165/175 |
| 4,969,512 | * | 11/1990 | Hisao et al. | 165/175 |
| 5,184,673 | * | 2/1993 | Hedman et al. | 165/153 |
| 5,634,519 | * | 6/1997 | Laveran | 165/175 |
| 5,638,900 | * | 6/1997 | Lowenstein et al. | 165/168 |

FOREIGN PATENT DOCUMENTS

| | | | | |
|---|---|---|---|---|
| 3500571 | * | 11/1985 | (DE) | 165/153 |
| 2 625 301 | | 6/1989 | (FR) . | |
| 2625301 | * | 6/1989 | (FR) | 165/153 |
| 859 837 | | 1/1961 | (GB) . | |
| 859837 | * | 11/1985 | (GB) | 165/153 |

* cited by examiner

*Primary Examiner*—Ira S. Lazarus
*Assistant Examiner*—Tho Duong
(74) *Attorney, Agent, or Firm*—Armstrong, Westerman, Hattori, McLeland & Naughton

(57) ABSTRACT

An oil cooler 11 comprises oil channel members 2A arranged one above another in parallel at a spacing and each composed of a pair of plates 20A, each of the plates 20A having a hole 21 at each of opposite ends thereof and a channel portion 22 between the end holes 21, the pair of plates 20A being joined with recessed surfaces of their channel portions 22 opposed to each other to form the oil channel member 2A; and annular header members 4A each interposed between each pair of adjacent oil channel members 2A at each of opposite lateral ends of the cooler. The header member 4A has upper and lower end faces each comprising a flat portion 41 to be fitted to a flat portion 24 of an edge of each plate 20A defining the end hole thereof and a recessed portion 42 to be fitted to a protuberant face of end 22*a* of the channel portion 22, each end face of the header member being joined to a peripheral edge portion of the plate 20A immediately adjacent thereto and defining an opening 20 formed by the end hole 21 of the plate and an open end of the channel portion 22 thereof for communication with the header member.

14 Claims, 15 Drawing Sheets

HEAT EXCHANGER

TECHNICAL FIELD

The present invention relates to heat exchangers, for example, for use as air-cooled oil coolers, after coolers, inter coolers, radiators, etc.

BACKGROUND ART

Plate fin heat exchangers of the so-called drawn cup type which can be manufactured with a high efficiency are generally used as heat exchangers for use as air-cooled oil coolers or air-cooled after coolers for various industrial devices. The heat exchangers of this type comprise fluid channel members and fins which are arranged alternately in layers, the channel members being each composed of a pair of dishlike plates which are joined as opposed to each other. Each of the plates has at each of its opposite ends a header recessed portion which is shaped in the form of a cup by drawing and formed with a fluid passing hole in its bottom wall. The holes thus formed in the fluid channel members provide a header at each end of the heat exchanger.

In the case of the heat exchangers described, however, the plates are shaped by press work using a single kind of die, so that there arises a need to prepare another die anew when the length of the core portions, i.e., the length of the plates, is to be changed. Especially in the case of heat exchangers for industrial devices or apparatus which exchangers are fabricated in many kinds in a small quantity for each kind, it has been difficult to prepare plates of different lengths to meet the demands in view of the production cost of different dies.

In the case of the plate fin heat exchanger of the drawn cup type described, the cup-shaped header recessed portions of the plates have a reduced thickness smaller than the plate thickness owing to the drawing work, with the result that the headers become insufficient in pressure resistance, vibration resistance and corrosion resistance.

Conventional heat exchangers include those which comprise fluid channel members each formed by joining a pair of dishlike plates, or a dishlike plate and a flat plate, and annular header members each interposed between the corresponding ends of each pair of adjacent fluid channel members.

With such heat exchangers, the header members are superior to the header recessed portions of the plate fin heat exchanger of the drawn cup type in resistance to pressure, vibration and corrosion, whereas since the dishlike plates are similarly shaped by press work using a single kind of die, there arises a need to prepare another die anew when the length of the core portions, i.e., the length of the plates, is to be changed.

Heat exchangers are also available conventionally which comprise fluid channel members each composed of an intermediate plate having a channel forming slit and flat outer plates joined respectively to opposite sides of the intermediate plate, and annular header members each interposed between the corresponding ends of each pair of adjacent fluid channel members.

The heat exchangers of this type are inferior to plate fin heat exchangers of the drawn cup type in productivity, while there is a need to prepare another die anew when the length of the intermediate plates is to be changed. Additionally, if it is attempted to form a piping socket communication bore across two adjacent header members, for example, for connection to piping of increased diameter, the fluid channel member comprising three plates and having a relatively large thickness will offer resistance to the flow of fluid through the socket communication bore. It is therefore impossible to form the piping socket communication bore, consequently limiting the freedom to position the piping connection correspondingly.

An object of the present invention is to provide a heat exchanger which readily permits changes in the length of its core portions as demanded although comparable to plate fin heat exchangers of the drawn cup type in productivity and which comprises headers having high resistance to pressure, vibration and corrosion and is less likely to be limited in the freedom to position the piping connection.

DISCLOSURE OF THE INVENTION

The present invention provides a heat exchanger comprising a plurality of fluid channel members arranged one above another in parallel at a spacing and each composed of a pair of plates, each of the plates having a fluid passing hole at each of opposite lateral ends thereof and a channel portion extending over the entire length thereof between the end holes for forming a fluid channel, the pair of plates being joined with recessed surfaces of their channel portions opposed to each other to form the fluid channel member; and annular header members each interposed between each pair of adjacent fluid channel members at each of opposite lateral ends of the heat exchanger, each of the header members having upper and lower end faces each comprising a flat portion to be fitted to a flat portion of an edge of each plate defining the end hole thereof and a recessed portion to be fitted to a protuberant end face of the plate channel portion, the upper and lower end faces of each of the header members at each of the opposite lateral ends of the exchanger being joined to a peripheral edge portion of the plate immediately adjacent thereto and defining an opening formed by the end hole of the plate and an open end of the channel portion thereof for communication with the header member to form a header at each of the opposite lateral ends.

With the heat exchanger of the present invention, the plates and the header members are joined into an exchanger body, for example, by collective vacuum brazing, so that the heat exchanger is comparable to plate fin heat exchangers of the drawn cup type in productivity.

The plates of the heat exchanger each have a fluid passing hole at each of opposite lateral ends thereof and a channel portion extending over the entire length thereof between the end holes for forming a fluid channel, so that the length of the plates can be altered with extreme ease as demanded. The heat exchanger is therefore suited especially for use as heat exchangers for industrial devices which exchangers are to be fabricated in many kinds in a small quantity for each kind.

The annular header members for forming the header can be obtained, for example, by cutting a hollow extrudate having a relatively large thickness into blocks of predetermined size and forming a recessed portion partly in the cut end faces of the cut blocks. The header members are therefore easy to make and excellent in resistance to pressure, vibration and corrosion.

To be suitable, the material for the plates is a double-faced aluminum brazing sheet in view of bondability, whereas other metal may alternatively be used.

The annular header members can be obtained by cutting a hollow extrudate, for example, of aluminum (including an aluminum alloy, the same as hereinafter) having a relatively large thickness into blocks of predetermined size and forming a recessed portion partly in the cut end faces of the cut blocks. The header members are therefore easy to make and excellent in resistance to pressure, vibration and corrosion.

An outer fin, which is usually a corrugated fin, is interposed between each pair of adjacent fluid channel members of the heat exchanger. An inner fin, such as an offset fin or corrugated fin of the straight type, may further be inserted in the fluid channel of the fluid channel member. Side plates are disposed externally of the respective fluid channel members at opposite ends of the arrangement of channel members in layers with respect to the direction of arrangement, with a header member of the same shape as the header members interposed between each side plate and the channel member adjacent thereto at each lateral end of the exchanger. A piping socket is usually attached to each of these side plates. In this case, an outer fin is interposed also between each side plate and the fluid channel member adjacent thereto.

In the heat exchanger described, at least one of the opposite end holes of each plate is divided into front and rear portions by a striplike partition extending laterally, the channel portion of the plate being divided into front and rear portions by a ridgelike partition projecting in the form of a reverse channel toward a recessed side of the channel portion and having a top wall extending laterally so as to be integral with the striplike partition, the header members at at least one of the opposite lateral ends of the exchanger each having a hollow portion divided into front and rear portions by a vertical partition wall corresponding to the striplike partition of the plate, the recessed portion in each of the upper and lower end faces of each header member with the vertical partition wall being divided into front and rear portions by a protruding partition fittable to a recessed end of the rigidlike partition of the plate, each of upper and lower end faces of the vertical partition wall being joined to the striplike partition of the plate opposed thereto, the protruding partition of the recessed portion in the end face of the header member being joined to the recessed end of the ridgelike partition of the plate opposed thereto.

The structure described above affords independent front and rear two groups of fluid channels and headers. The front group which is the upstream side of air is used as an after cooler portion, and the rear group which is the downstream side of air as an oil cooler for the heat exchanger to serve economically as a composite cooler.

A fluid can be caused to flow through the two fluid channels of each fluid channel member in countercurrent relation. This achieves an improved heat exchange efficiency, consequently making it possible to compact the heat exchanger in its entirety.

The present invention provides another heat exchanger which comprises a plurality of fluid channel members arranged one above another in parallel at a spacing and each composed of a first plate and a second plate, the first plate having a fluid passing hole at each of opposite lateral ends thereof and a channel portion extending over the entire length thereof between the end holes for forming a fluid channel, the second plate having a fluid passing hole at each of opposite lateral ends thereof, the plates being joined with a recessed surface of the channel portion of the first plate opposed to the second plate to form the fluid channel member; and annular header members each interposed between each pair of adjacent fluid channel members at each of opposite lateral ends of the heat exchanger, each the header members having upper and lower end faces one of which comprises a flat portion to be fitted to a peripheral edge portion of the second plate defining the end hole thereof, the other end face comprising a flat portion to be fitted to a flat portion of an edge of the first plate defining the end hole thereof and a recessed portion to be fitted to a protuberant end face of the channel portion of the first plate, one of the upper and lower end faces of each of the header members at each of the opposite lateral ends of the exchanger being joined to the hole-defining peripheral edge portion of the second plate opposed thereto, the other end face being joined to a peripheral edge portion of the first plate opposed thereto and defining an opening formed by the end hole of the first plate and an open end of the channel portion thereof for communication with the header member to form a header at each of the opposite lateral ends.

In this heat exchanger, the first plate has a fluid passing hole at each of opposite lateral ends thereof and a channel portion extending over the entire length thereof between the end holes for forming a fluid channel, and the second plate has a fluid passing hole at each of opposite lateral ends thereof. Accordingly, the length of these plates can be altered with extreme ease as demanded. The heat exchanger is therefore suited especially for use as heat exchangers for industrial devices which exchangers are to be fabricated in many kinds in a small quantity for each kind.

In the heat exchanger described, at least one of the opposite end holes of the first plate is divided into front and rear portions by a striplike partition extending laterally, the channel portion of the first plate being divided into front and rear portions by a ridgelike partition projecting in the form of a reverse channel toward a recessed side of the channel portion and having a top wall extending laterally so as to be integral with the striplike partition, at least one of the opposite end holes of the second plate being divided into front and rear portions by a striplike partition corresponding to the striplike partition of the first plate, the header members at at least one of the opposite lateral ends of the exchanger each having a hollow portion divided into front and rear portions by a vertical partition wall corresponding to the striplike partition of the plate, the recessed portion in one of the upper and lower end faces of each header member with the vertical partition wall being divided into front and rear portions by a protruding partition fittable to a recessed end of the ridgelike partition of the plate, each of upper and lower end faces of the vertical partition wall being joined to the striplike partition of the plate opposed thereto, the protruding partition of the recessed portion in the end face of the header member being joined to the recessed end of the ridgelike partition of the plate opposed thereto.

The structure described above affords independent front end rear two groups of fluid channels and headers. The front group which is the upstream side of air is used as an after cooler portion, and the rear group which is the downstream side of air as an oil cooler for the heat exchanger to serve economically as a composite cooler.

A fluid can be caused to flow through the two fluid channels of each fluid channel member in countercurrent relation. This achieves an improved heat exchange efficiency, consequently making it possible to compact the heat exchanger in its entirety.

In the heat exchanger described, a piping socket communication bore may be formed across at least two adjacent header members of the header at at least one of the opposite lateral ends of the exchanger, with one end of at least one pair of plates of the fluid channel member positioned in the socket communication bore.

The piping socket communication bore formed across the two adjacent header members of the header has positioned therein one end of at least one pair of plates which end is relatively thin and is therefore unlikely to offer great resistance to the flow of fluid through the socket communication bore. This increases the freedom to position the piping connection even when an inlet pipe or outlet pipe of great diameter is used.

In the heat exchanger described, the pair of plates forming the fluid channel member each preferably have a vertical wall extending longitudinally thereof along each of front and rear edges of the plate between the corresponding pair of laterally opposed header members so as to be in contact with outer surfaces of the opposed header members for determining the inward position of the opposed header members.

In the heat exchanger described, the channel portion of each of the pair of plates constituting the fluid channel member is preferably formed at opposite ends thereof with respective vertical walls extending transversely of the plate so as to be in contact with inner surfaces of the corresponding pair of laterally opposed header members for determining the outward position of the opposed header members. Preferably, the plate having the transverse vertical walls is also provided with the inward position determining vertical walls described.

In the heat exchanger wherein the fluid channel member comprises the first plate and the second plate, the channel portion of the first plate and an inner portion of the second plate defining the opposite end holes are each preferably formed at opposite ends thereof with respective vertical walls extending transversely of the plate so as to be in contact with inner surfaces of the corresponding pair of laterally opposed header members for determining the outward position of the opposed header members.

In the heat exchanger described, the first plate and the second plate which form the fluid channel member each preferably have, in addition to the outward position determining vertical walls, a vertical wall extending longitudinally thereof along each of front and rear edges of the plate between the corresponding pair of laterally opposed header members so as to be in contact with outer surfaces of the opposed header members for determining the inward position of the opposed header members.

In fabricating the heat exchanger of the invention wherein the vertical walls are provided for determining the inward position of the header members, by arranging the fluid channel members and header members in a multiplicity of layers to assemble an exchanger core of specified shape and collectively brazing the assembly as restrained by a jig at opposite sides, the outer surface of each header member is held in contact with the inward position determining vertical walls of the corresponding plate, whereby the header member is reliably prevented from shifting inwardly of the exchanger core. Accordingly the opening portion of each header member is accurately positioned in register with the communication opening of the corresponding fluid channel member. The heat exchanger can therefore be fabricated easily and made free of fluid leakage.

In fabricating the heat exchanger wherein the vertical walls are provided for determining the outward position of the header members by collective brazing as described above, the inner surface of each header member is held in contact with the outward position determining vertical wall of the corresponding plate, whereby the header member is prevented from shifting outwardly of the exchanger core.

In fabricating the heat exchanger which has both the vertical walls for determining the inward position of the header members and the vertical walls for determining the outward position of the header members, i.e., the heat exchanger defined in the appended claim 8, by collective brazing, each header member has its outer surface held in contact with the inward position determining vertical walls of the corresponding plate and is thereby prevented from shifting inwardly of the exchanger core while having its outer surface held in contact with the outward position determining vertical wall of the plate and being effectively prevented from shifting outwardly of the core, whereby the heat exchanger can be fabricated more accurately and easily by collective brazing.

In the heat exchanger described, the pair of plates constituting the fluid channel member are each preferably formed, along an edge thereof defining each of the opposite end holes, with a slanting wall positioned at an acute angle with an inner surface of the header member and integral with the flat portion and the channel portion.

In the heat exchanger wherein the header members each have the vertical partition wall, the pair of plates constituting the fluid channel member are each preferably formed, along an edge thereof defining the end hole having the striplike partition, with a slanting wall positioned at an acute angle with an inner surface of the header member and an inner surface of the vertical partition wall and integral with the flat portion, the striplike partition and the channel portion.

In the heat exchanger wherein the fluid channel members each comprise the first plate and the second plate, the first plate is preferably formed, along an edge thereof defining each of the opposite end holes, with a slanting wall positioned at an acute angle with an inner surface of the header member and integral with the flat portion and the channel portion.

In the heat exchanger wherein the fluid channel members each comprise the first plate and the second plate, and the header members each have the vertical partition wall, the first plate is preferably formed, along an edge thereof defining the end hole having the striplike partition, with a slanting wall positioned at an acute angle with an inner surface of the header member and an inner surface of the vertical partition wall and integral with the flat portion, the striplike partition and the channel portion.

With the heat exchanger described, the portion of the plate to be fitted in its entirety to each header member in lapping relation is not in the form of a flat plate which is liable to deform during the assembling procedure but is provided with a slanting wall fittable in the header member. Accordingly, the entire plate is given enhanced strength and less prone to deformation. Moreover, a sufficient amount of brazing material can be filled in between the inner surface of the header member and the outer surface of the slanting wall.

Further in the case of the heat exchanger wherein the slanting wall makes an acute angle with the vertical wall of the header and is integral with the striplike partition, a sufficient quantity of brazing material can be filled in between the surface of the vertical partition wall and the outer surface of the slanting wall in addition to the portion of the brazing material applied to the header member inner surface. This assures more reliable brazing.

BEST MODE OF CARRYING OUT THE INVENTION

Figure 1:
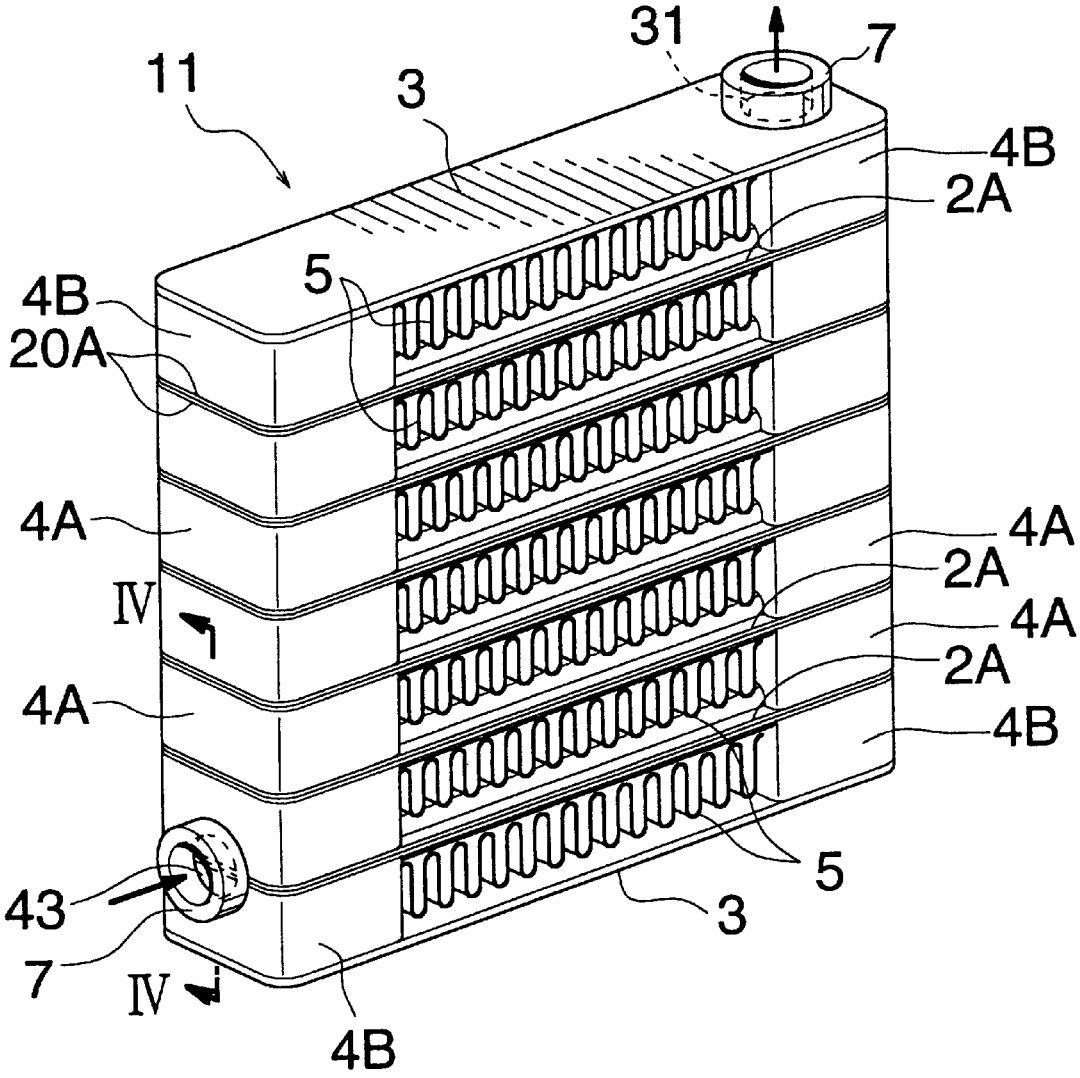
FIG. 1 is a perspective view of an oil cooler according to a first embodiment of the invention.

The best mode of carrying out the invention, i.e., heat exchangers embodying the invention, will be described with reference to the drawings.

First Embodiment

This embodiment is an application of the present invention to an air-cooled oil cooler 11 for industrial devices such as compressors, and is shown in FIGS. 1 to 6.

The oil cooler 11 comprises six oil channel members 2A arranged one above another in parallel at a spacing and each composed of a pair of plates 20A, two upper and lower side plates 3 disposed externally of and spaced apart from the respective oil channel members 2A at the upper and lower ends of the arrangement, annular header members 4A each interposed between each pair of adjacent oil channel members 2A at each of opposite lateral ends of the arrangement, an annular end header member 4B interposed between each side plate 3 and the oil channel member 2A adjacent thereto at each of opposite lateral ends of the arrangement, outer fins 5 interposed between lengthwise intermediate portions of each pair of adjacent oil channel members 2A and between lengthwise intermediate portions of each side plate 3 and the oil channel member 2A adjacent thereto, inner fins 6 inserted in oil channels A of the respective oil channel members 2A, and two piping sockets 7 for connection to an oil inlet pipe and an oil outlet pipe, respectively.

Each of the pair of plates 20A constituting the oil channel member 2A comprises a double-faced aluminum brazing sheet which is in the form of a laterally elongated rectangle when seen from above. The plate 20A has a generally square or rectangular oil passing hole 21 at each of opposite lateral ends thereof, and a channel portion 22 extending over the entire length thereof between the end holes 21 for forming the oil channel. The plate 20A has an opening 23 communicating with the header member 4A and formed by the hole 21 and an open end of the channel portion 22 which end is continuous with the hole.

The plate 20A is made from a plate blank cut to a predetermined size by forming the two holes 21 and the channel portion 22 in the blank at the same time by press work. The die to be used for the work is preferably one dividable into two segments at the midportion of the length thereof. It is then possible to readily prepare plates 20A of different lengths as desired by interposing an intermediate die member between the divided die segments and using the resulting die for press work. Alternatively the plate 20A may be prepared by forming the channel portion 22 in the plate blank cut to the predetermined size by press work and then forming the two holes 21 in the respective opposite ends of the plate blank similarly by press work. The length of plate 20A is then easily variable within the range of the sum of the lateral lengths of the two holes 21 even if a single kind of press die is used for forming the channel portion 22.

Each side plate 3 comprises a double-faced or single-faced aluminum brazing sheet having the same contour as the plate 20A. The upper side plate 3 has an oil outlet bore 31 in its right end.

Figure 2:
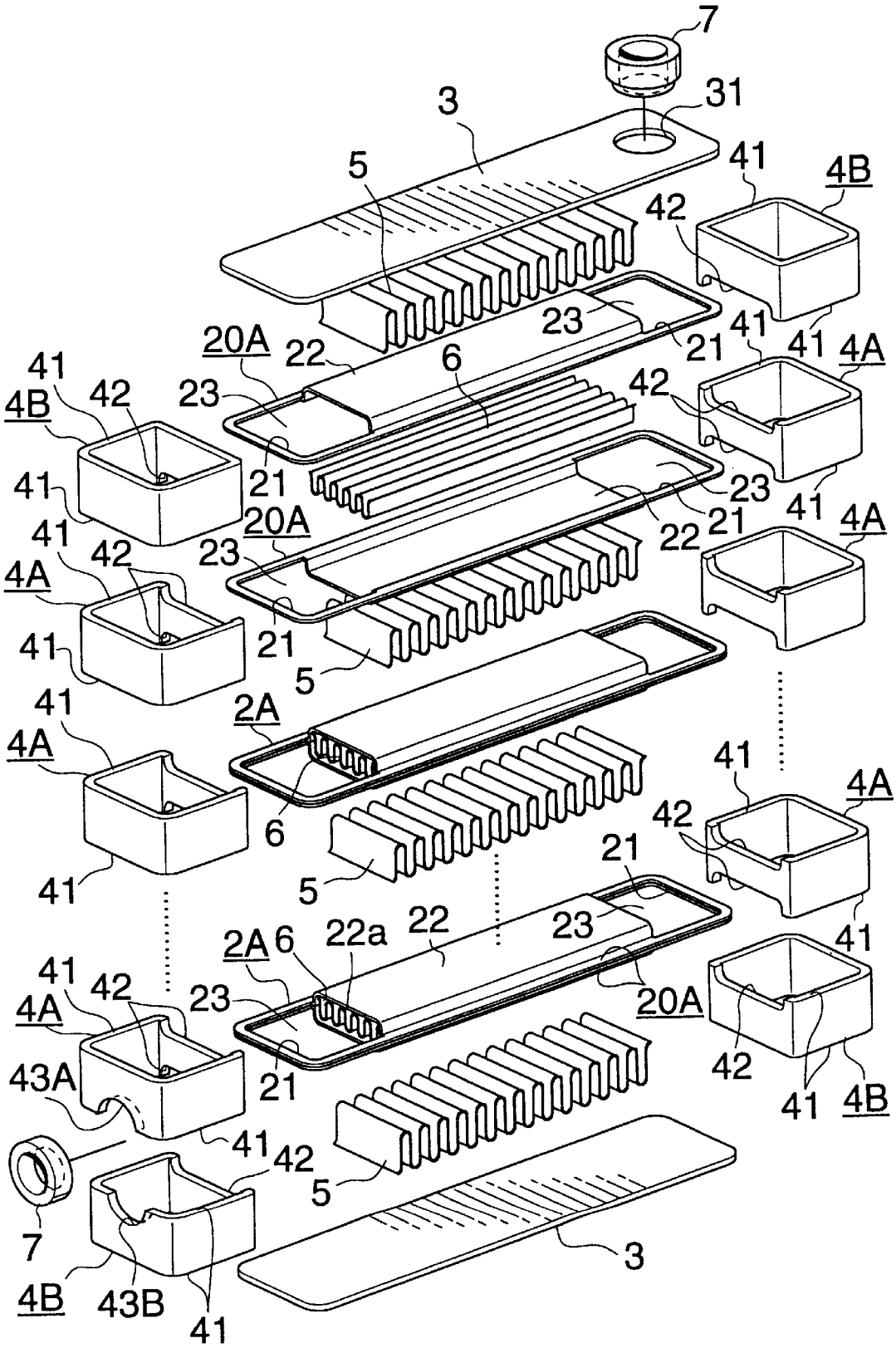
FIG. 2 is an exploded perspective view of the oil cooler of the first embodiment.
Figure 3:
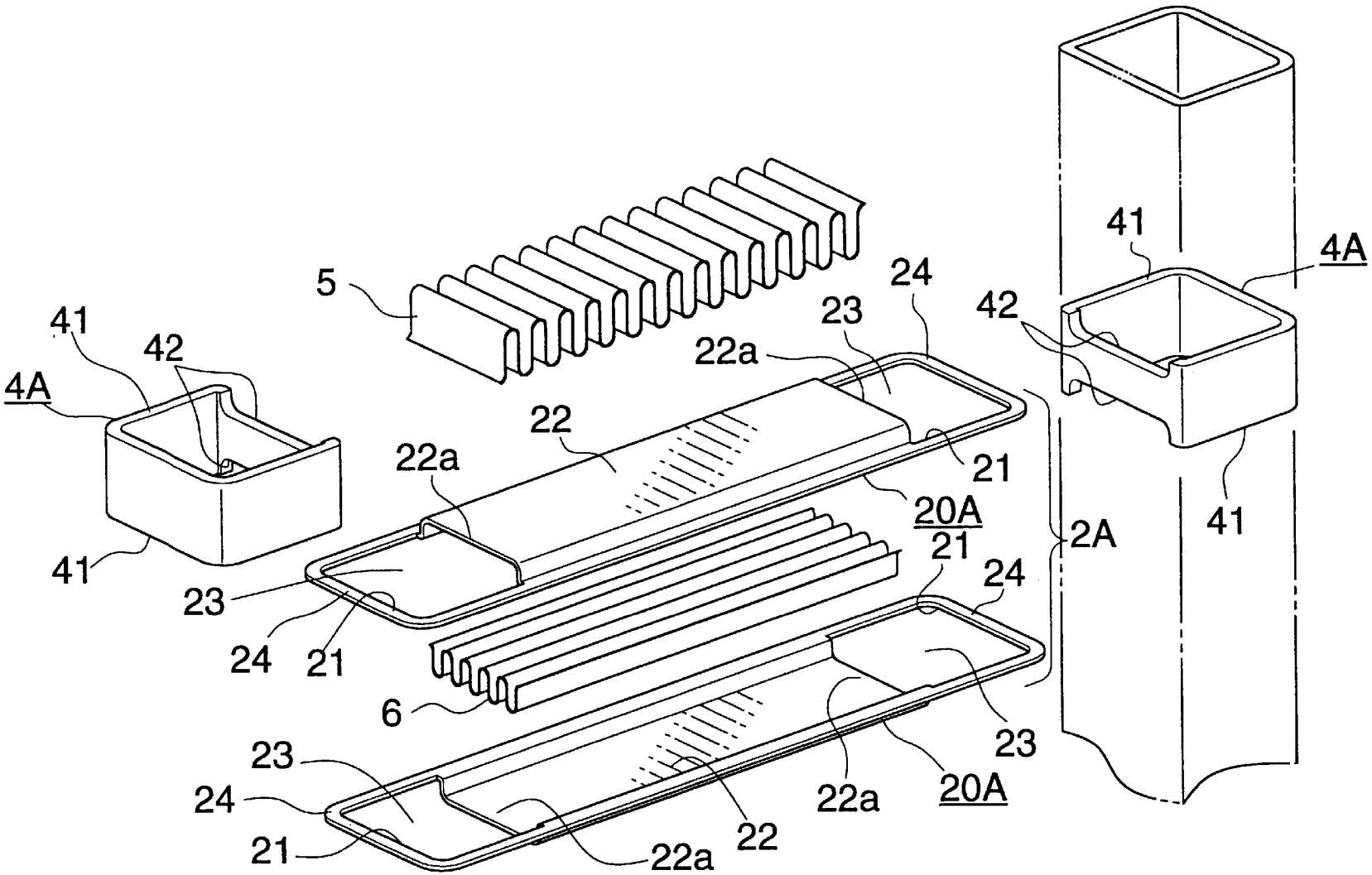
FIG. 3 is an exploded enlarged perspective view showing one unit of the oil cooler of the first embodiment on an enlarged scale.

The pair of plates 20A are brazed with the recessed faces of their channel portions 22 opposed to each other, whereby the oil channel member 2A is formed (see FIGS. 2 and 3).

Many header members 4A are obtained by cutting a hollow aluminum extrudate of approximately square or rectangular cross section into lengths. Each of the upper and lower end faces of the header member 4A comprises a flat portion 41 to be fitted to a plate portion 24 of the hole-defining edge of each of the plates 20A paired to constitute the oil channel member 2A which portion 24 is approximately U-shaped when seen from above, and a recessed portion 42 to be fitted to a protuberant face of end 22*a* of channel portion 22 of the plate 20A (see FIGS. 2 and 3). These recessed portions 42 are formed by press work or cutting.

The end header member 4B is obtained similarly from a hollow aluminum extrudate of approximately square or rectangular cross section. Of the upper and lower end faces of the member 4B, the end face to be opposed to the plate 20A comprises a flat portion 41 to be fitted to the flat portion 24 of the hole-defining edge of the plate 20A, and a recessed portion 42 to be fitted to the protuberant face of end 22*a* of channel portion 22 of the plate 20A. The other end face to be opposed to the side plate 3 comprises only a flat portion 41 to be fitted to the inner surface of the side plate 3 (see FIG. 2).

At each of the opposite lateral ends of the cooler, the upper and lower end faces of each header members 4A are each brazed to the peripheral edge portion of the plate 20A immediately adjacent thereto and defining the opening 23 which comprises the hole 21 of the plate 20A and the open end of the channel portion 22 thereof for communication with the header member 4A, one of the upper and lower end faces of each and header member 4B is brazed to the peripheral edge portion of the plate 20A immediately adjacent thereto and defining the opening 23 for communication with the member 4B, and the other end face is brazed to the inner surface of the side plate 3 immediately adjacent thereto.

The outer fin 5 is in the form of a corrugated aluminum fin and has its crest portions and bottom portions brazed to the outer surfaces of pair of plates 20A constituting the oil channel member 2A.

The inner fin 6 is similarly in the form of a corrugated aluminum fin and has its crest portions and bottom portions brazed to the inner surfaces of pair of plates 20A constituting the oil channel member 2A.

Figure 4:
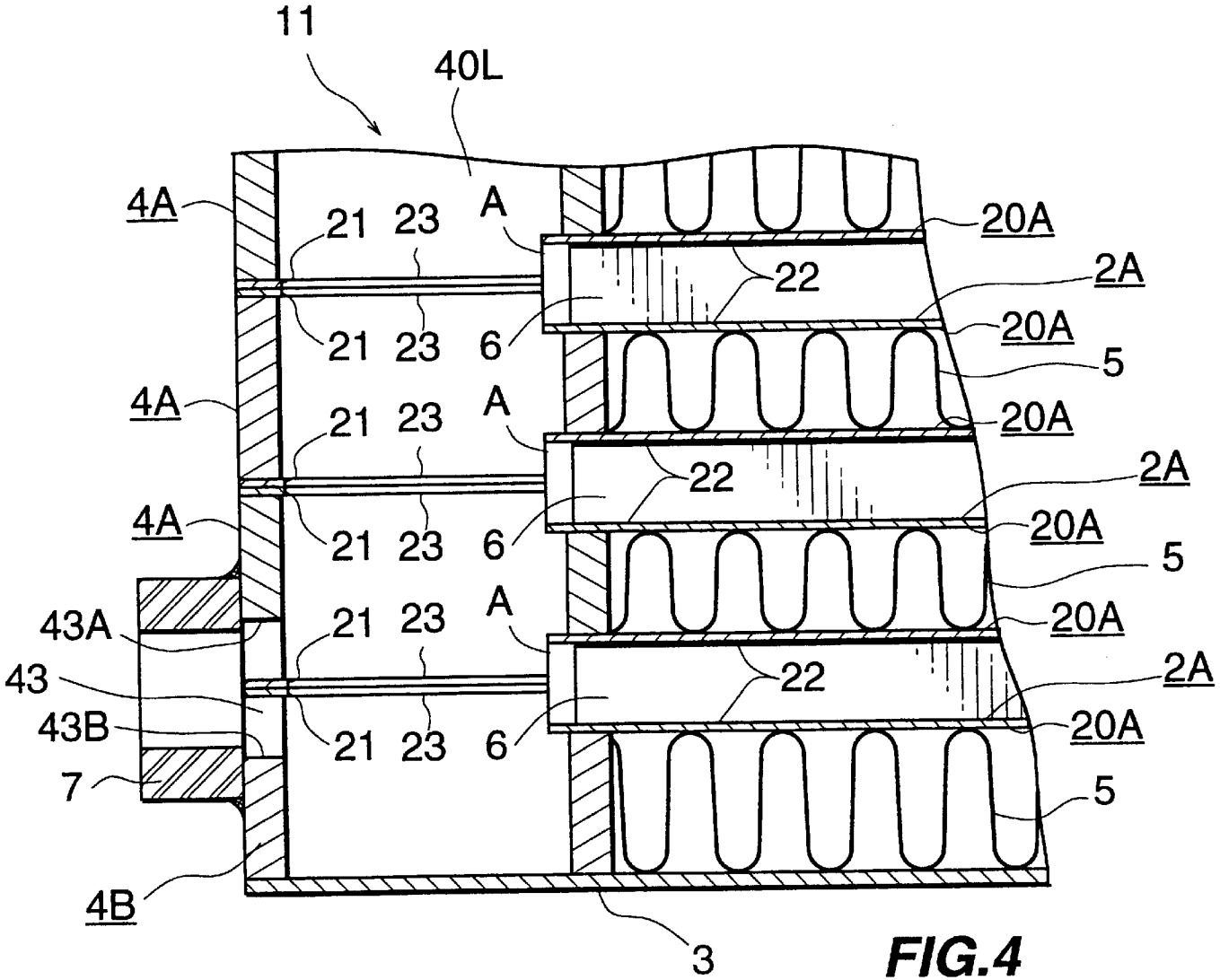
FIG. 4 is an enlarged view in section taken along the line IV—IV in FIG. 1 and showing a portion, including an oil inlet, of the oil cooler of the first embodiment on an enlarged scale.
Figure 5:
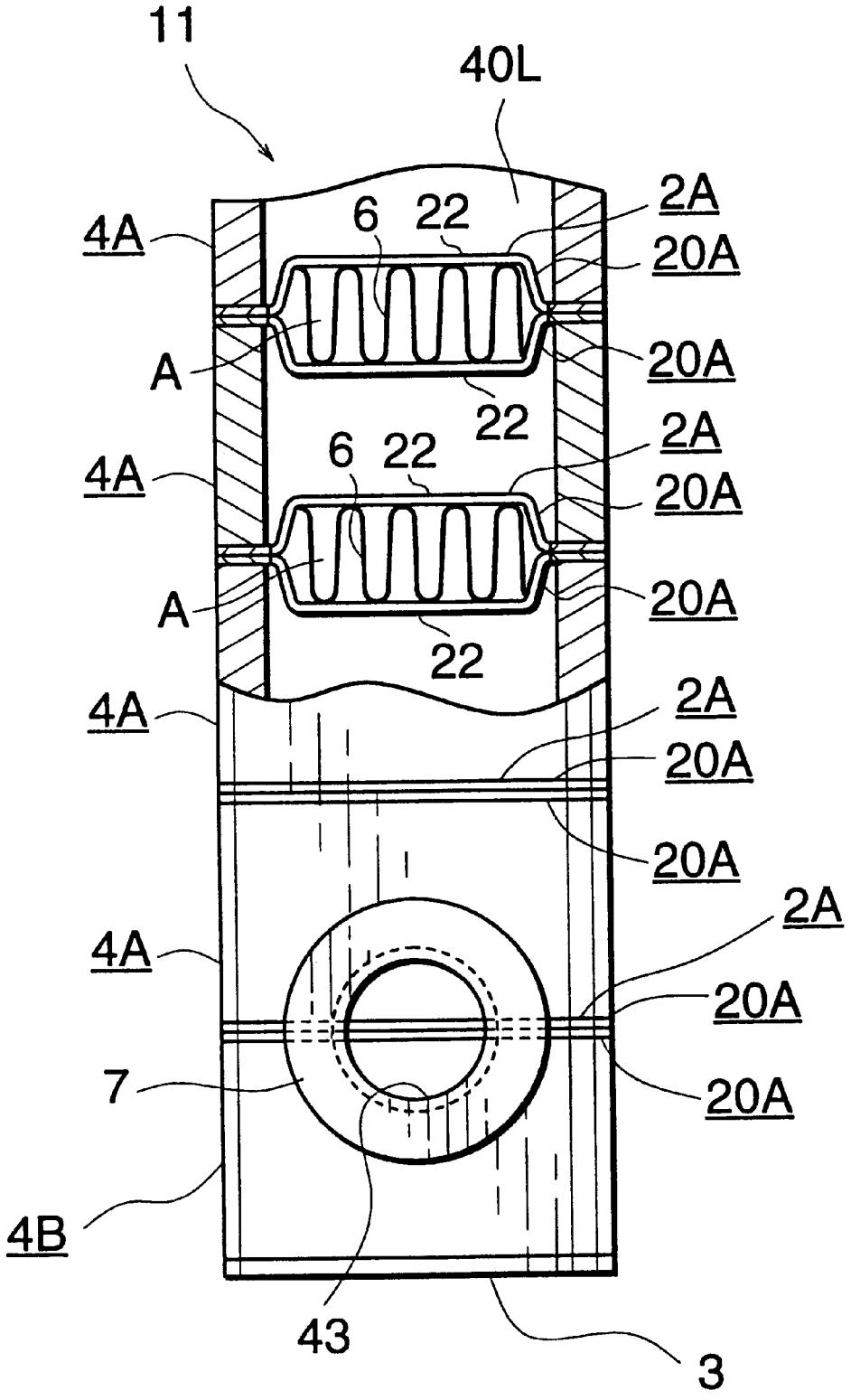
FIG. 5 is an enlarged side elevation partly broken away and showing the portion, including the oil inlet, of the oil cooler of the first embodiment.

The piping socket 7 is made of aluminum, is in the form of an annular member having an internally threaded portion, and is welded to the outer surfaces of left side walls of the end header member 4B positioned at the left lower end of the oil cooler 11 and the header member 4A adjacent to the member 4B, at edge portions of the walls defining a socket communication bore 43 (see FIGS. 1, 2, 4 and 5). The bore 43 is formed by semicircular cutouts 43B, 43A formed in the respective side walls of the end header member 4B and the header member 4A. As shown in FIGS. 4 and 5, the left ends of the pair of plates 20A positioned in the socket communication bore 43 have a relatively small thickness and will not offer great resistance to the passage of oil through the bore 43, therefore causing no trouble when the oil cooler 11 is used.

The piping socket 7 is similarly made of aluminum, in the form of a generally annular member having an internally threaded portion and welded to the upper side plate 3 with its lower end portion of reduced outside diameter fitted in the socket communication bore 31 formed in the right end portion of the upper side plate 3 (see FIGS. 1 and 2).

The oil cooler 11 can be obtained, for example, by assembling in a specified state the components, i.e., the plates 20A, side plates 3, header members 4A, end header members 4B, outer fins 5 and inner fins 6, joining the components collectively by vacuum brazing while restraining the assembly by a jig and welding the two piping sockets 7 individually to the header members 4A, 4B concerned and to the side plate 3, so that the cooler is available with high productivity. The piping socket 7 for connection to the oil outlet pipe can be joined to the side plate 3 by collective vacuum brazing.

Figure 6:
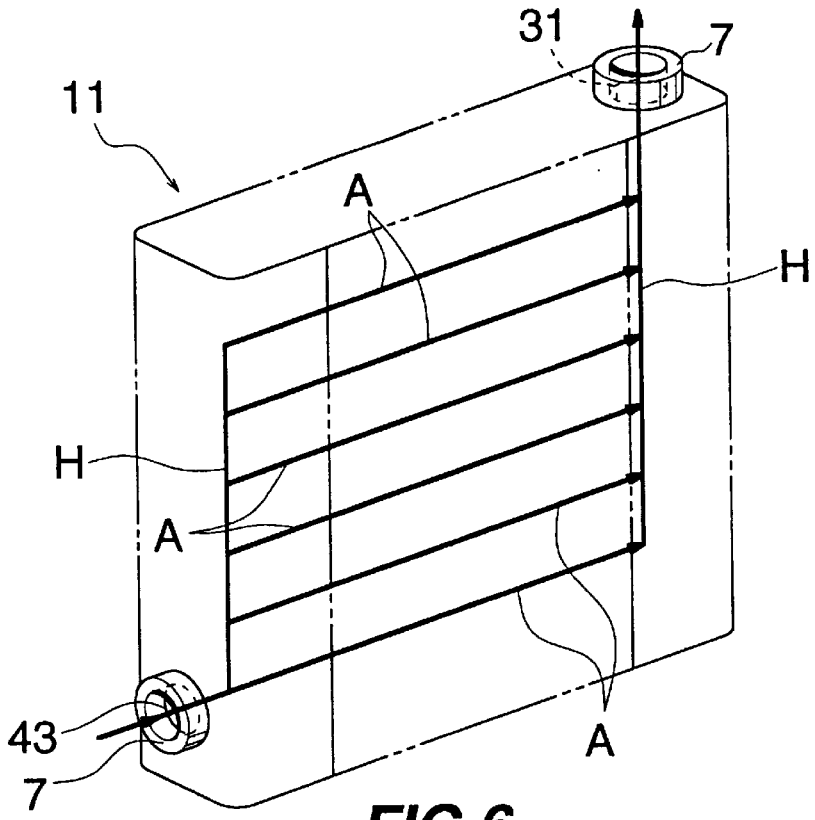
FIG. 6 is a diagram for illustrating the flow of oil through the oil cooler of the first embodiment.

With reference to FIG. 6, oil of high temperature flows into the oil cooler 11 described above through one of the bores, 43, and then into the oil channels A of the oil channel members 2A from the left rightward through the header H at the left end. At this time, the high-temperature oil flowing through the oil channels A undergoes heat exchange with air of low temperature flowing through the cooler transversely thereof between the lengthwise intermediate portions of the adjacent oil channel members 2A and between the lengthwise intermediate portions of the upper and lower side plates 3 and the lengthwise intermediate portions of the oil channel members 2A adjacent to the respective plates 3, whereby the oil is cooled. The cooled oil is thereafter run off from the other bore 31 through the header H at the right end.

Figure 7:
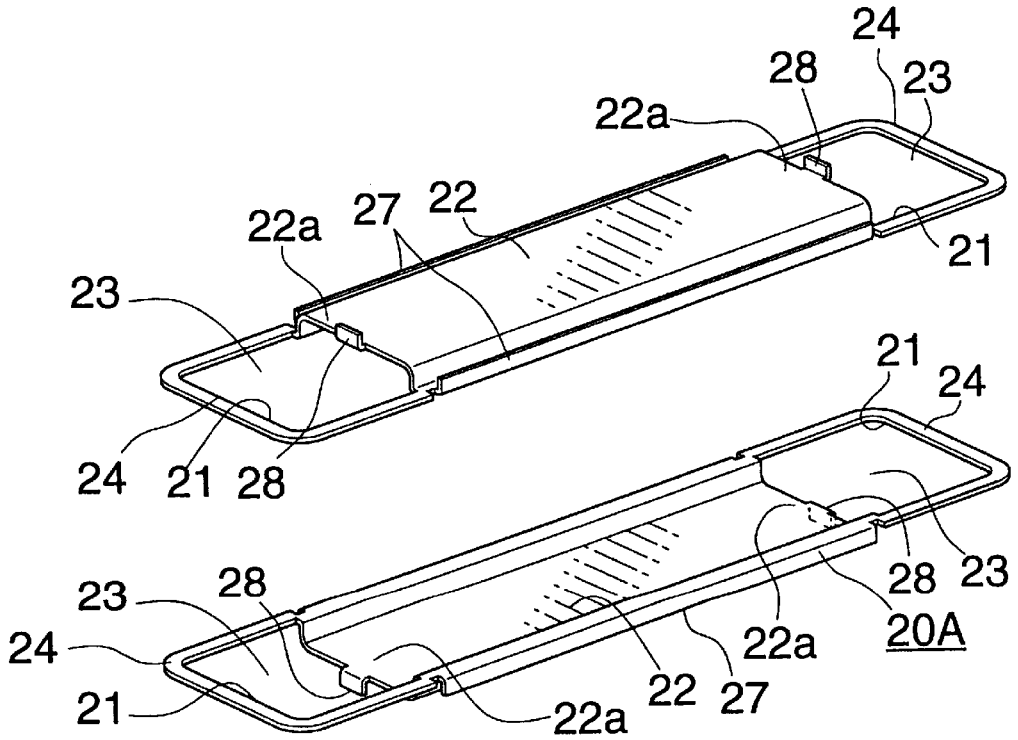
FIG. 7 is an exploded perspective view showing a pair of modified plates for use in the first embodiment.
Figure 8:
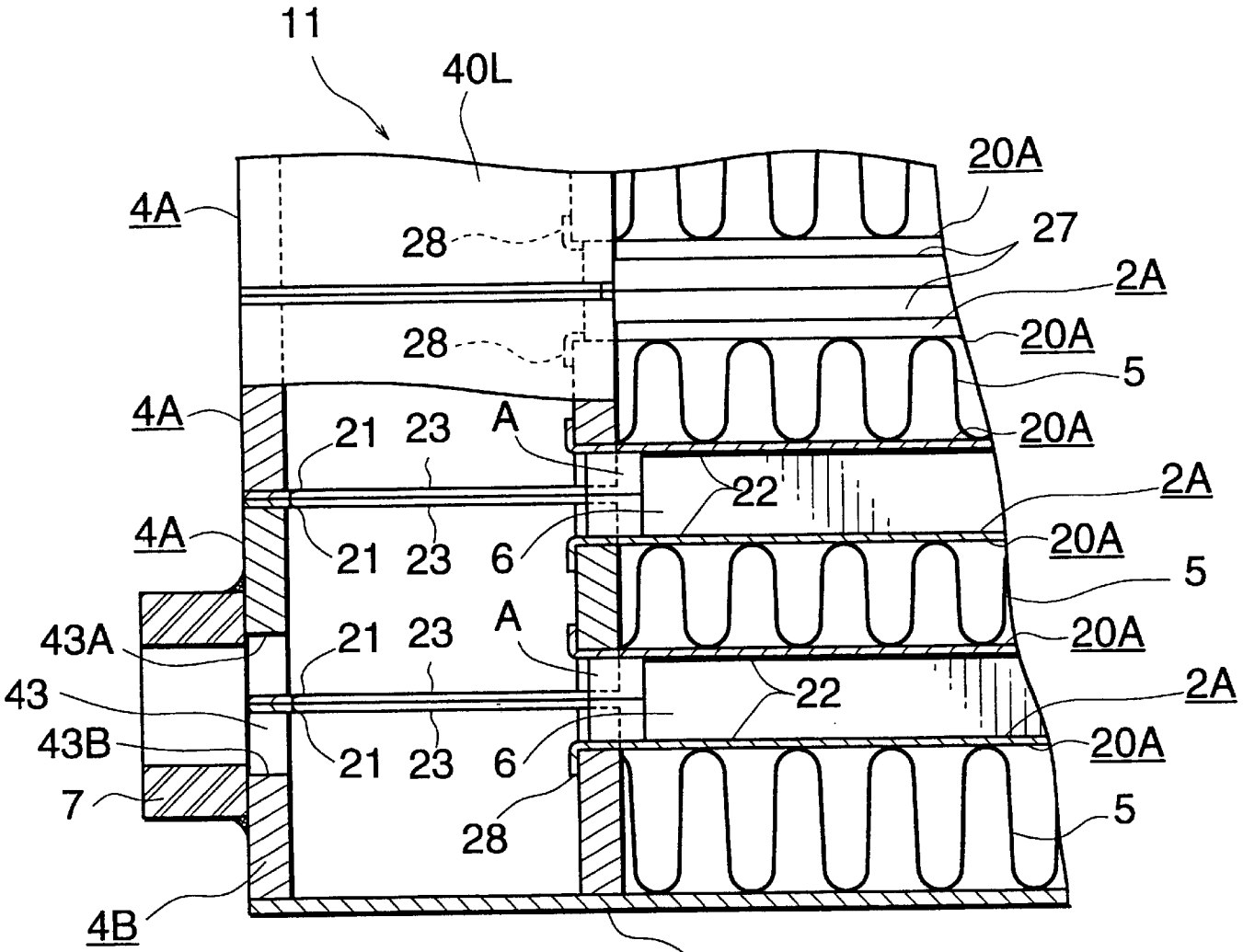
FIG. 8 is a side elevation partly broken away, corresponding to FIG. 5 and showing the plates of FIG. 7 as used in the embodiment.
Figure 9:
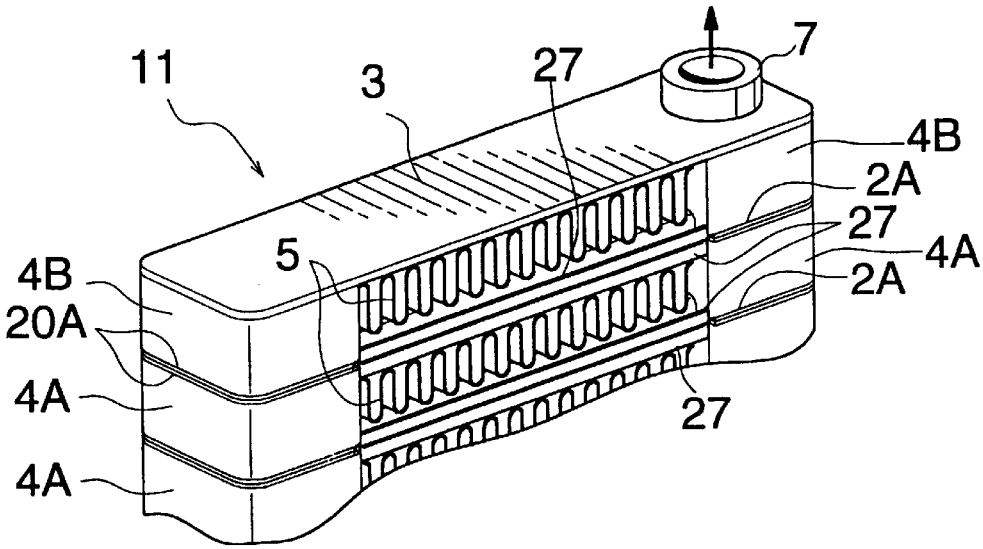
FIG. 9 is a fragmentary perspective view of the oil cooler of the first embodiment wherein the plates of FIG. 7 are used.

FIGS. 7 to 9 show a modification of pair of plates 20A for forming the oil channel member 2A. According to the modification, the pair of plates 20A each have a vertical wall 27 extending longitudinally thereof along each of its front and rear edges between the left and right header members 4A so as to be in contact with the outer surfaces of these header members 4A for determining the inward position of the header members 4A. The channel portion 22 of each of the pair of plates 20A is formed at its opposite ends with respective vertical walls 28 extending transversely of the plate so as to be in contact with the inner surfaces of the respective left and right header members 4A for determining the outward position of these header members.

Figure 10:
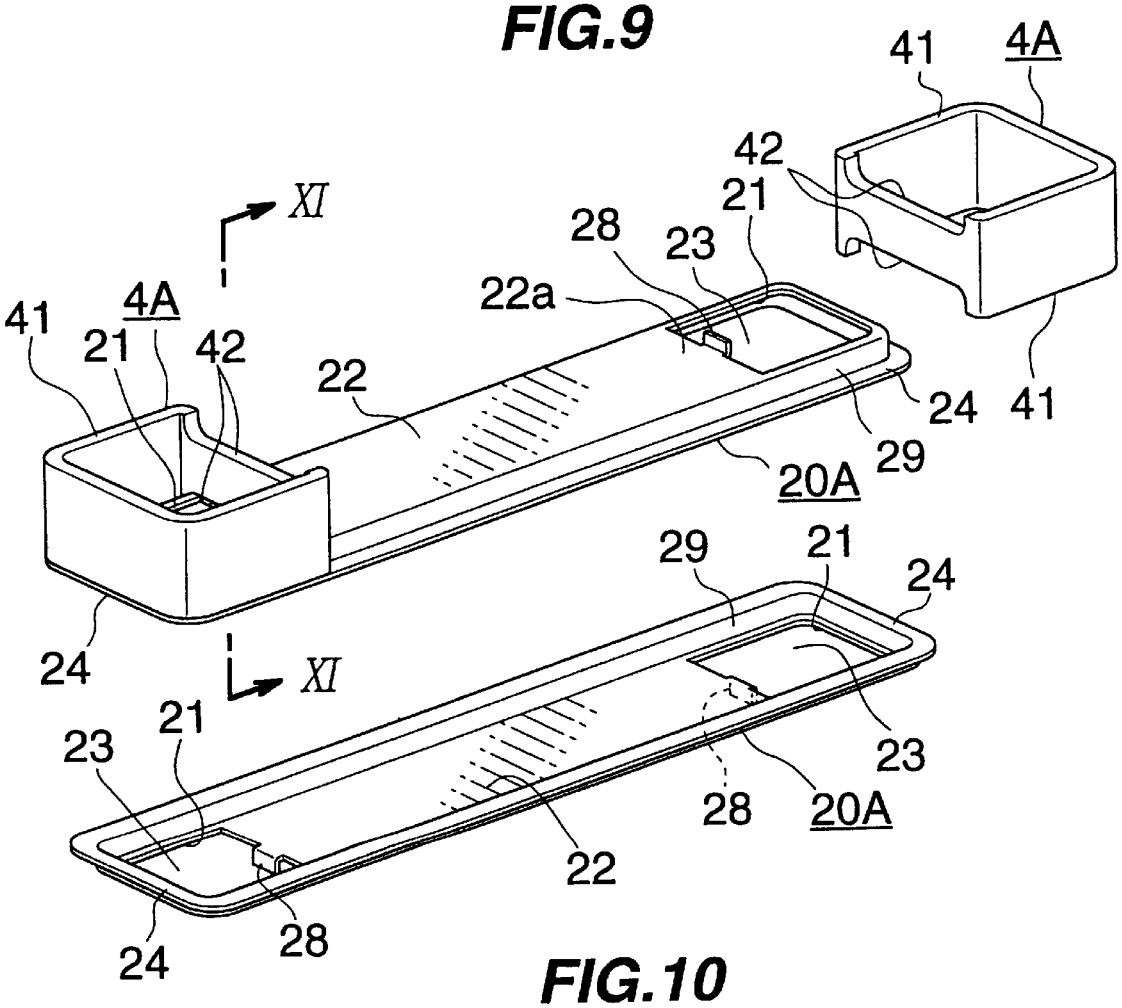
FIG. 10 is an exploded perspective view showing another modification of pair of plates along with left and right header members for use in the first embodiment.
Figure 11:
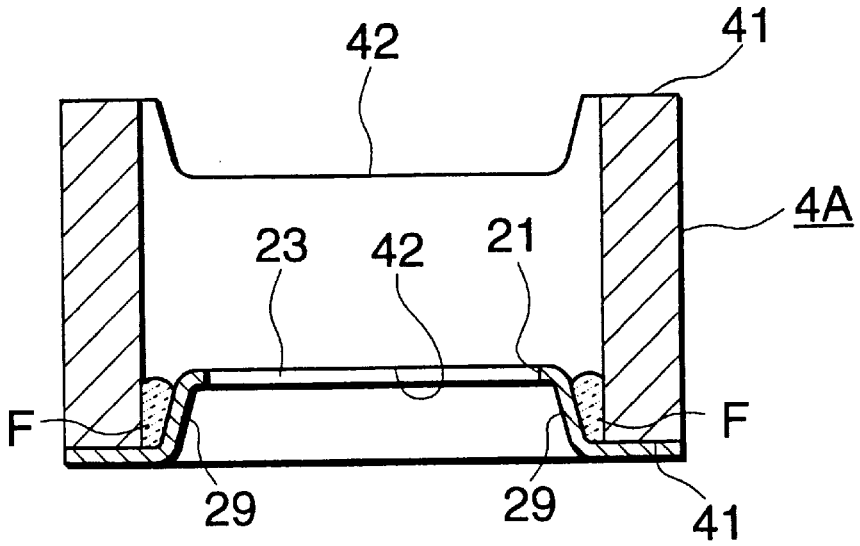
FIG. 11 is an enlarged view in section taken along the line XI—XI in FIG. 10.

FIGS. 10 and 11 show another modification of pair of plates 20A constituting the oil channel member 2A. The pair of plates 20A constituting the oil channel member 2A are each formed, along the edge defining each of the left and right holes 21, with a slanting wall 29 integral with the flat portion 24 and the channel portion 22 and to be positioned at an acute angle with the inner surface of the header member 4A. With this modification, a sufficient amount of brazing material F can be filled in between the inner surface of the header member 4A and the inner surface of the slanting wall 2*a* to result in stabilized brazing.

According to the illustrated modification, the left and right holes 21 are formed in respective left and right extensions of the bottom wall 22*a* of the channel portion 22 which are flush with the wall 22*a*, whereas these extensions need not always be at the same level as the bottom wall 22*a*.

Further this modification may be provided only with the vertical wall 27 for determining the outward position of each of the corresponding header members.

Second Embodiment

This embodiment is an application of the present invention to a composite cooler which comprises an air-cooled oil cooler and an air-cooled after cooler in combination for industrial devices such as compressors, and is shown in FIGS. 12 to 15.

This composite cooler 12 has the same construction as the first embodiment, i.e., the oil cooler 11, shown in FIGS. 1 to 6 with the exception of the following features.

Figure 13:
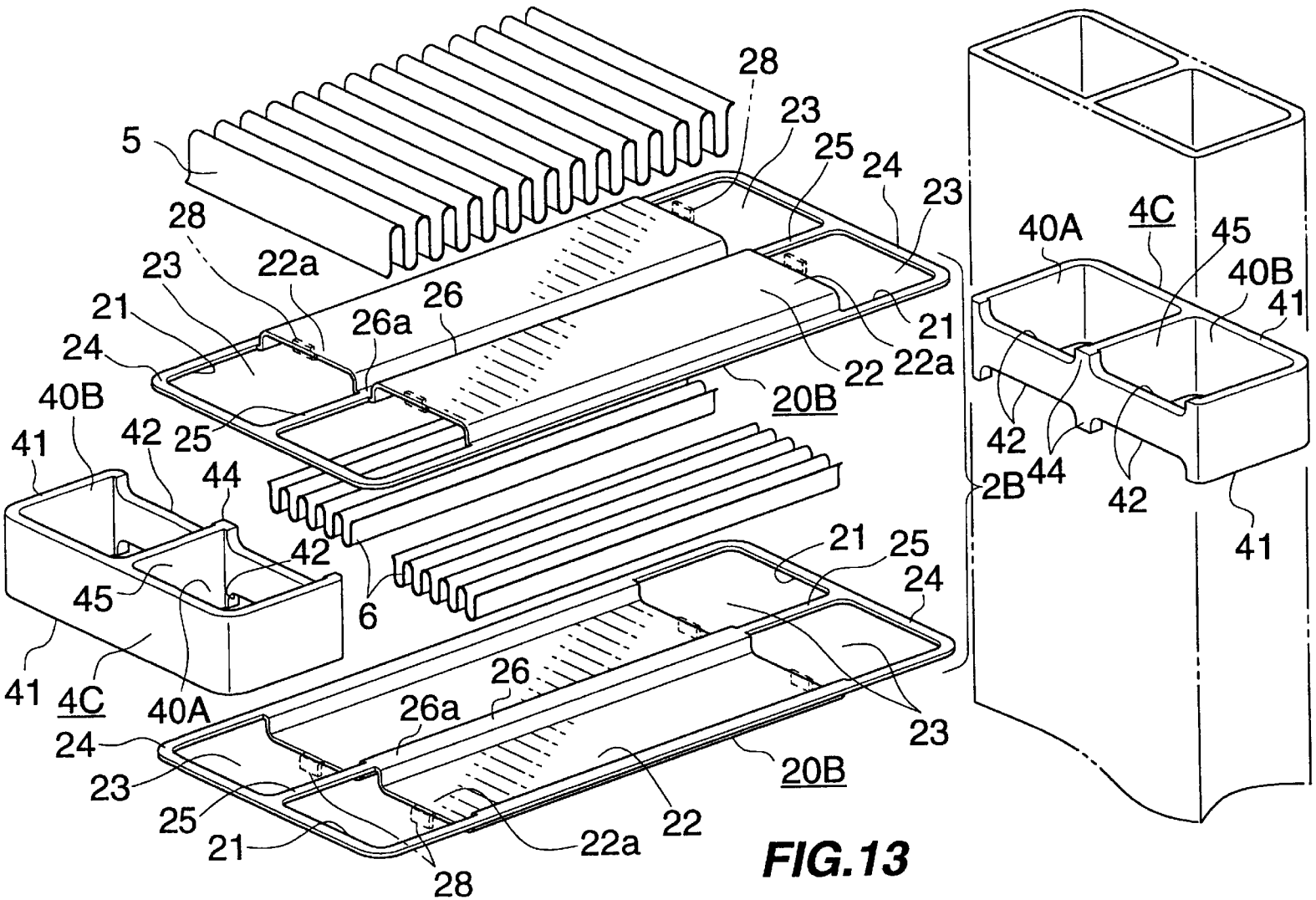
FIG. 13 an exploded perspective view showing one unit of the composite cooler of the second embodiment on an enlarged scale.
Figure 14:
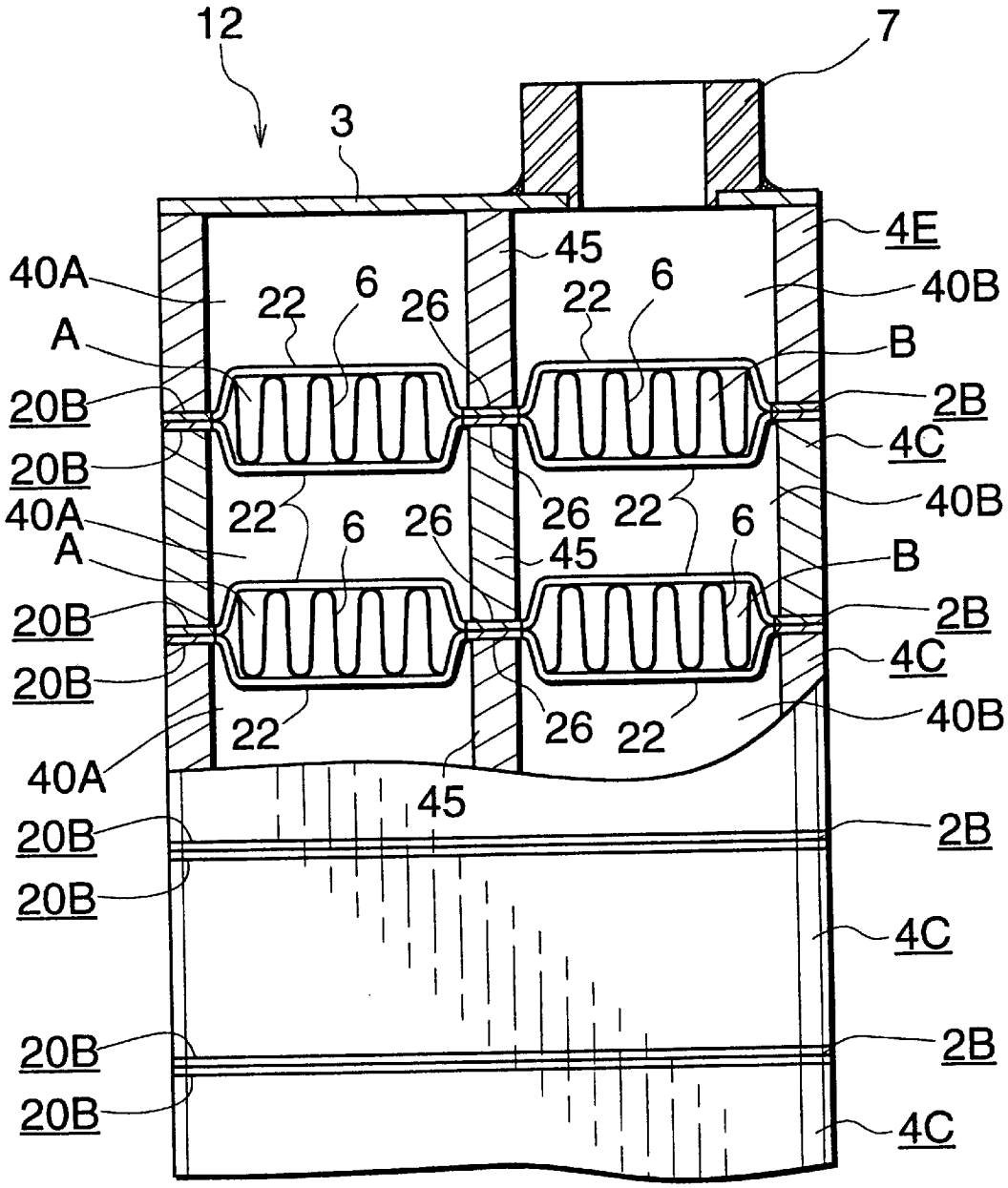
FIG. 14 is an enlarged side elevation partly broken away and showing a portion, including a compressed air outlet, of the composite cooler of the second embodiment.

With reference to FIGS. 13 and 14, plates 20B of the composite cooler 12 each have opposite lateral end holes 21 and a pair of striplike partitions 25 dividing the respective holes 21 each into front and rear two portions. Each of the plates 20B has a channel portion 22 divided into front and rear two portions by a ridgelike partition 26 projecting in the form of a reverse channel toward the recessed side of the channel portion 22 and having a top wall 16*a* extending laterally so as to be integral with the striplike partitions 25. A pair of plates 20B are joined with the recessed surfaces of their channel portions 22 opposed to each other, whereby a compressed air-oil channel member 2B is formed.

Header members 4C each have a hollow portion divided into front and rear two portions by a vertical partition wall 43 corresponding to the striplike partition 25 of the plate 20B. A recessed portion 42 in each of the upper and lower end faces of each header member 4C is divided into front and rear two portions by a protruding partition 44 fittable in the recessed end of the ridgelike partition 26 of the plate 20B (see FIG. 8). End header members 4E also each have a hollow portion divided into front and rear two portions by a vertical partition wall 45 corresponding to the striplike partition 25 of the plate 20B. Of the upper and lower end faces of the end header member 4E, the end face to be opposed to the plate 20B has a recessed portion 42 which is divided into front and rear two portions by a protruding partition 44 fittable in the recessed end of the ridgelike partition 26 of the plate 20B.

Figure 12:
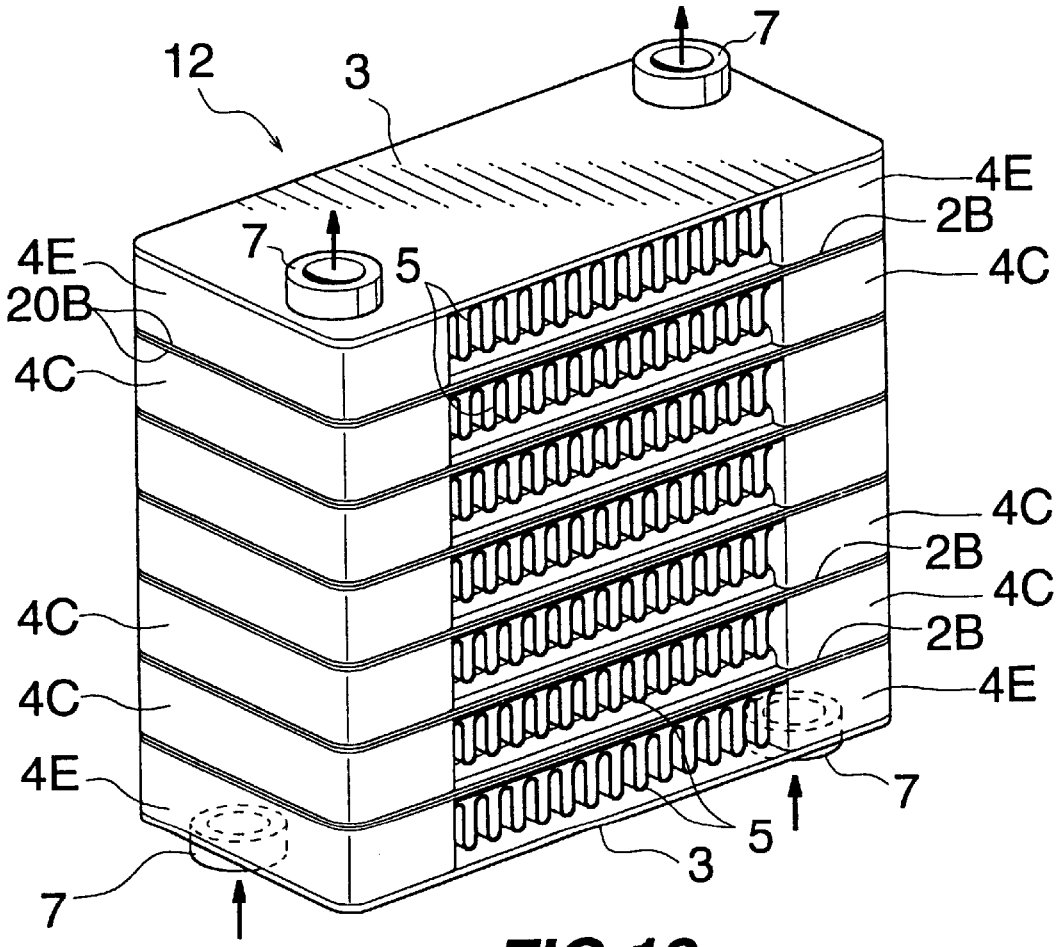
FIG. 12 is a perspective view of a composite cooler according to a second embodiment of the invention.

Each of the upper and lower end faces of the vertical partition wall 45 of the header member 4C is joined to the striplike partition 25 of the plate 20B opposed thereto, and the protruding partition 44 of the recessed portion 42 in each of the upper and lower end faces of the header member 4C is joined to the recessed end of the ridgelike partition 26 of the plate 20B opposed thereto (see FIGS. 12 to 14). Each of the upper and lower end faces of the vertical partition wall 45 of the end header member 4E is joined to the striplike partition 26 of the plate 20B opposed thereto or to the inner surface of a side plate 3 opposed thereto, and the protruding partition 44 of the recessed portion 42 formed in one of the upper and lower end faces of the end header member 4E is joined to the recessed end of the ridgelike partition 26 of the plate 20B opposed thereto.

The composite cooler 12 comprises an after cooler portion provided by compressed air channels B at the front side, i.e., air upstream side, of the compressed air-oil channel members 2B and compressed air passing hollow portions 40B at the front side of the header members 4C, and an oil cooler portion provided by oil channels A at the rear side, i.e., air downstream side, of the fluid channel members 2B and oil passing hollow portions 40A at the rear side of the header members 4C.

Inner fins 6 are inserted in the front compressed air channels B and the rear oil channels A of the channel members 2B (see FIGS. 13 and 14).

With the composite cooler 12, the lower side plate 3 has a compressed air inlet bore at a right-end front portion thereof and an oil inlet bore at a left-end rear portion thereof, and the upper side plate 3 has a compressed air outlet bore at a left-end front portion thereof and an oil outlet bore at a right-end rear portion thereof. A piping socket 7 is joined to the bore-defining peripheral edge portion of the plate in communication with each of these bores.

The composite cooler 12 is fabricated by the same process as the oil cooler 1 of the first embodiment.

Figure 15:
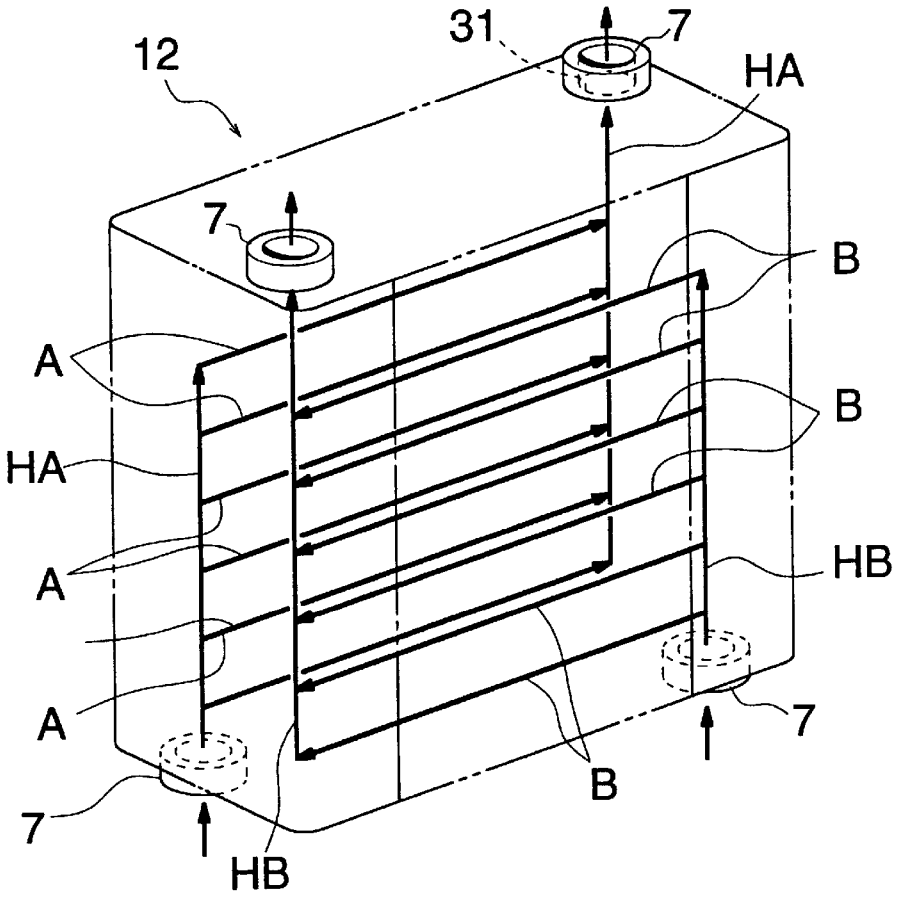
FIG. 15 is a diagram for illustrating the flows of compressed air and oil through the composite cooler of the second embodiment.

With reference to FIG. 15, compressed air having a high temperature and flowing into the after cooler portion of the composite cooler 12 from the compressed air inlet bore passes through a compressed air heater HB at the right end and then flows through the compressed air channels B of the channel members 2B from the right leftward. At this time, the compressed air of high temperature flowing through the air channels B undergoes heat exchange with air of low temperature flowing through the cooler from the front rearward between the lengthwise intermediate portions of each pair of adjacent channel members 2B and between the lengthwise intermediate portion of each of the upper and lower side plates 3 and the lengthwise intermediate portion of the channel member 2B adjacent thereto, through the plates 20B, outer fins 5 and inner fins 6, whereby the compressed air is cooled. The cooled compressed air thereafter flows through a compression air header HB at the left end and is run off from the compressed air outlet bore. At the same time, oil having a high temperature and flowing into the oil cooler portion of the composite cooler 12 via the oil inlet bore passes through an oil header HA at the left end and then flows through the oil channels A of the channel members 2B from the left rightward. At this time, the oil of high temperature flowing through the oil channels A undergoes heat exchange with the air of low temperature, whereby the oil is cooled. The cooled oil thereafter flows through an oil header HA at the right end and is run off through the oil outlet bore.

Although not shown, the second embodiment may be modified like the pair of modified plates of the first embodiment. The pair of plates 20B may each have a vertical wall 27 extending longitudinally thereof along each of its front and rear edges between the left and right header members 4C so as to be in contact with the outer surfaces of these header members 4C for determining the inward position of the header members 4C. Further as indicated in chain lines in FIG. 13, the channel portion 22 of each of the pair of plates 20B may be formed at each of its opposite ends with two vertical walls 28 extending transversely of the plate and positioned at opposite sides of the ridgelike partition 26 so as to be in contact with the inner surface of the corresponding header member 4C for determining the outward position of the header member.

Figure 16:
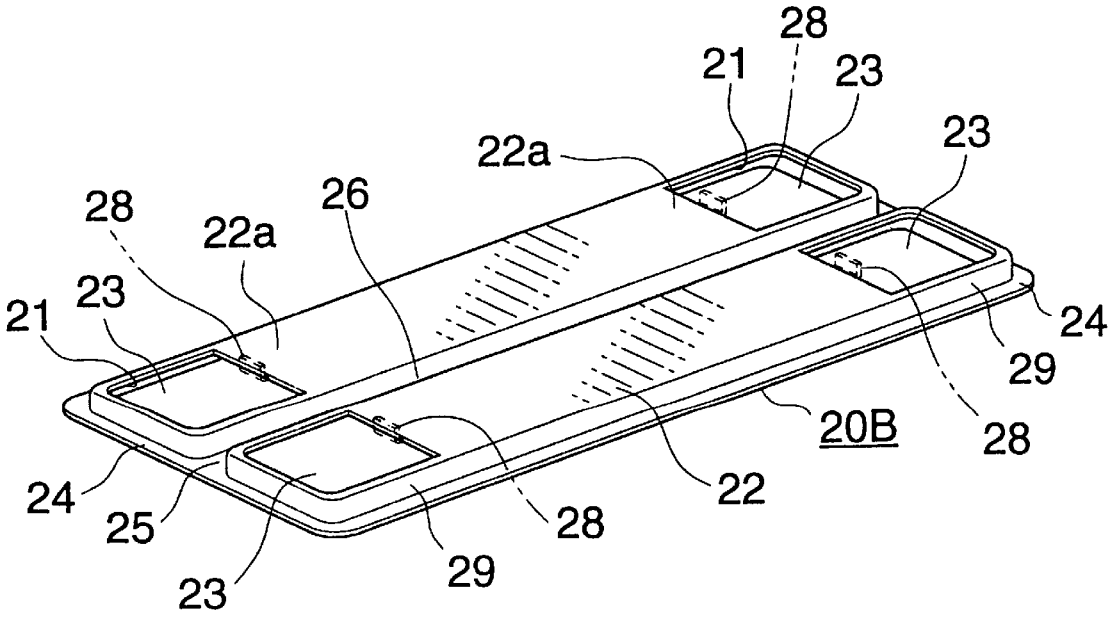
FIG. 16 is an exploded perspective view showing a modified plate for use in the second embodiment.

The second embodiment may be further modified like another modification of pair of plates of the first embodiment. The pair of plates 20B constituting the compressed air-oil channel member 2B may each be formed, along the edge defining each of the left and right holes 21, with a slanting wall 29 integral with the flat portion 24 and the channel portion 22 and to be positioned at an acute angle with the inner surface of the header member 4C. With the second embodiment, the slanting wall 29 makes an acute angle also with the surface of the vertical partition wall 45 and is integral with the striplike partition 25. Of the pair of plates according to this modification, the upper plate 20B only is shown in FIG. 16; the lower plate is symmetrical to the upper plate. According to this modification, a sufficient amount of brazing material F can be filled in between the outer surface of the slanting wall 29 and the inner surface of the header member 4C and between the slanting wall outer surface and the surface of the partition wall 45 opposed thereto.

According to the illustrated modification, the left and right holes 21 are formed in respective left and right extensions of the bottom wall 22*a* of the channel portion 22 which are flush with the wall 22*a*, whereas these extensions need not always be at the same level as the bottom wall 22*a*.

Further this modification may have only the vertical walls 27 indicated in chains lines in FIG. 16 and formed in the same manner as described with reference to FIG. 13 for determining the outward position of the corresponding header member.

Third Embodiment

Figure 17:
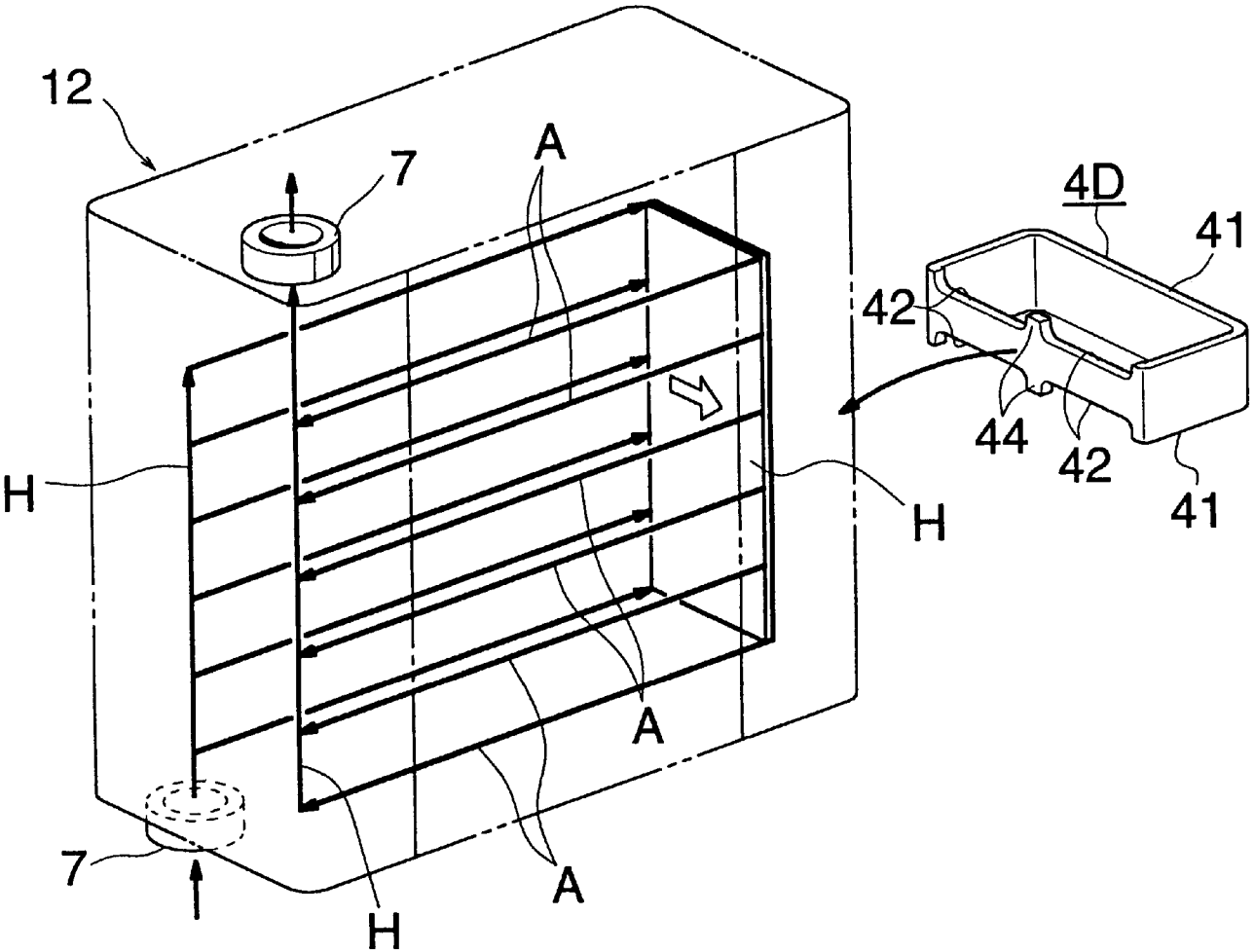
FIG. 17 is a diagram showing a header member included in an oil cooler according to a third embodiment of the invention and also showing the flow of oil through the oil cooler.

This embodiment is an application of the present invention to an air-cooled oil cooler for industrial devices such as compressors, and is shown in FIG. 17.

This oil cooler 13 has the same construction as the second embodiment, i.e., the composite cooler 12, shown in FIGS. 12 to 15 with the exception of the following feature.

As shown in FIG. 17, the oil cooler 13 has at the right end thereof header members 4D and end header members (not shown) which have no vertical partition walls 45. Accordingly, front and rear two headers H are formed at the left end of the oil cooler, and one header H is formed at the right end thereof.

The lower side plate 3 of the oil cooler 13 has an oil inlet bore at a left-end rear portion thereof, and the upper side plate 3 has an oil outlet bore at the left-end front portion. A piping socket 7 is joined to the peripheral edge portion of the plate defining each of these bores.

As shown in FIG. 17, oil having a high temperature and flowing into the oil cooler 13 via the oil inlet bore passes through the rear header H at the left end and then flows through the rear oil channels A of the oil channel members 2B from the left rightward into the header H at the right end, from which the oil flows through the front oil channels A of the oil channel members 2B from the right leftward in countercurrent relation with the oil flow through the rear oil channels A. At this time, the oil of high temperature flowing through the front and rear oil channels A undergoes heat exchange with air of low temperature flowing through the cooler from the front rearward between the lengthwise intermediate portions of each pair of adjacent oil channel members 2B and between the lengthwise intermediate portion of each of the upper and lower side plates 3 and the lengthwise intermediate portion of the oil channel member 2B adjacent thereto, through the plates 20B, outer fins 5 and inner fins 6, whereby the oil is cooled. The cooled oil thereafter flows through the front header H at the left end and is run off from the oil outlet bore.

The oil cooler 13 is so adapted that the oil flows through the front and rear oil channels A of the oil channel members 2B in countercurrent relation as described above, therefore achieves an improved heat exchange efficiency and can consequently be compacted.

Fourth Embodiment

Figure 18:
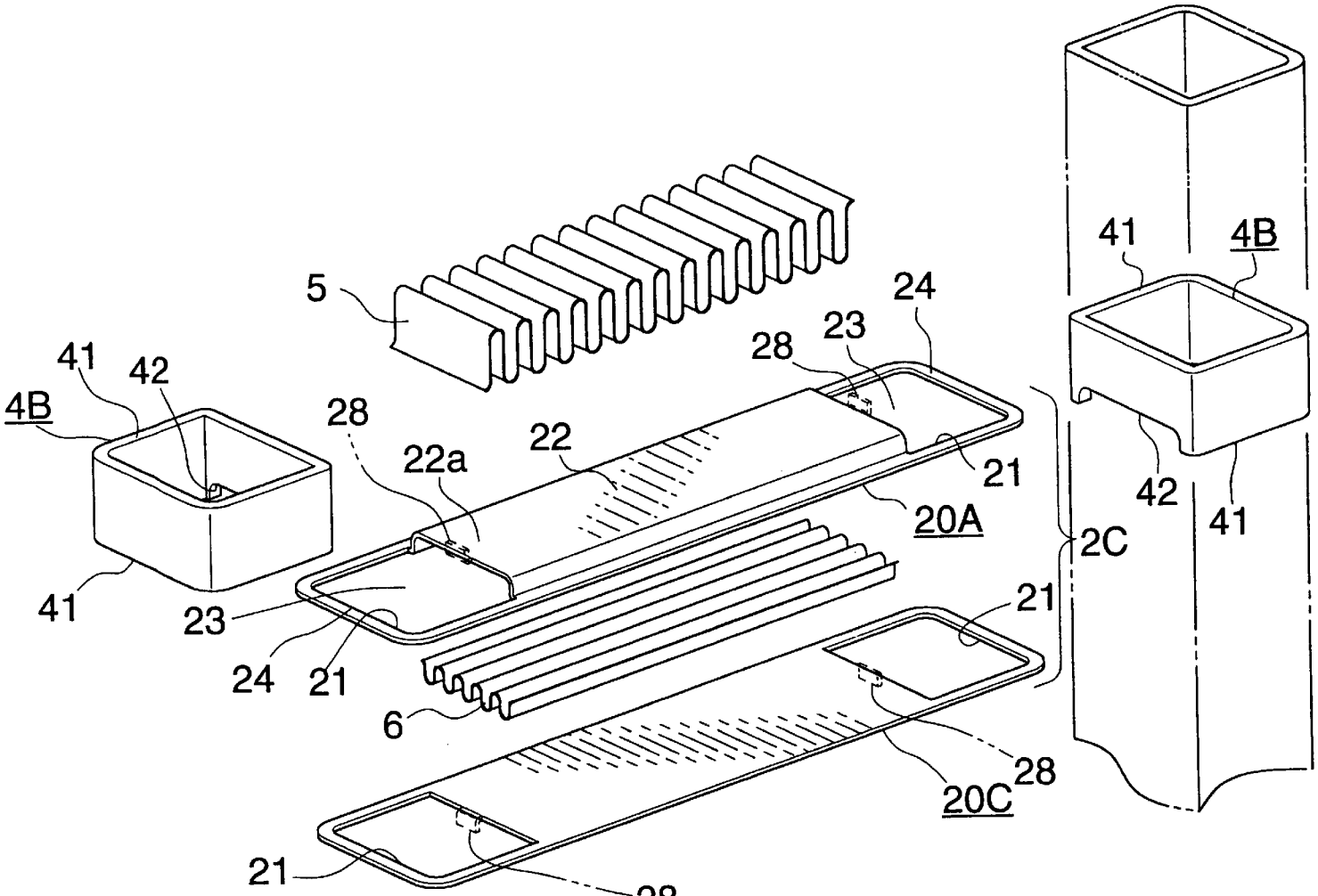
FIG. 18 is an exploded perspective view showing on an enlarged scale one unit of an oil cooler according to a fourth embodiment of the invention.

This embodiment is an application of the present invention to an air-cooled oil cooler for industrial devices such as compressors, and is shown in FIGS. 18.

This oil cooler has the same construction as the first embodiment, i.e., the oil cooler 11, shown in FIGS. 1 to 6 with the exception of the following feature.

The oil cooler comprises oil channel members 2C each comprising an upper first plate 20A having the same construction as the plate 20A shown in FIGS. 1 to 6, and a flat lower second plate 20C having a fluid passing hole 21 at each of opposite lateral ends thereof. These plates are joined with the recessed surface of the channel portion 22 of the first plate 20A down to form the fluid channel member 2C.

Header members 4B each interposed between each pair of adjacent fluid channel members 2C at each of opposite lateral ends of the cooler have the same construction as the end header member 4B of the oil cooler 11 according to the first embodiment. The header member 4B has an upper face which comprises a flat portion 41 to be fitted to the outer surface of the peripheral edge portion of the second plate 20C defining the end hole 21 thereof. The upper end face of the header member 4B is joined to the hole-defining peripheral edge portion of the second plate 20C opposed thereto. The lower end face of the header member 4B is joined to the peripheral edge portion of the first plate 20A opposed thereto and defining an opening 23 formed by the end hole 21 of the first plate 20A and the open end of the channel portion 22 thereof for communication with the header member.

In the case of this oil cooler, the second plate 20C need not be formed with the channel portion. Of the upper and lower end faces of the header member 4B, only the lower end face to be opposed to the first plate 20A needs to be worked on to form a recess portion 42. Accordingly, the number of working steps can be correspondingly decreased to achieve improved productivity.

Although not shown, the first plate 20A and the second plate 20C of the fourth embodiment described may each have a vertical wall 27 extending longitudinally thereof along each of front and rear edges the plate between the corresponding pair of laterally opposed header members 4B so as to be in contact with outer surfaces of the opposed header members 4B for determining the inward position of the opposed header members. Further as indicated in chain lines in FIG. 18, the channel portion 22 of the first plate 20A and the inner portion of the second plate 20C defining the opposite end holes 21 may each be formed at opposite ends thereof with respective vertical walls 28 extending transversely of the plate so as to be in contact with inner surfaces of the corresponding pair of laterally opposed header members 4B for determining the outward position of the opposed header members.

Like the upper plate 20A of FIG. 10, the first plate 20A of the fourth embodiment may be formed, along the edge defining each of the left and right holes 21, with a slanting wall 29 integral with the flat portion 24 and the channel portion 22 and to be positioned at an acute angle with the inner surface of the header member 4B. In addition to the slanting wall 29, the first plate 20A and the second plate 20C may be formed with vertical walls 28 for determining the outward position of the header member 4B.

Fifth Embodiment

Figure 19:
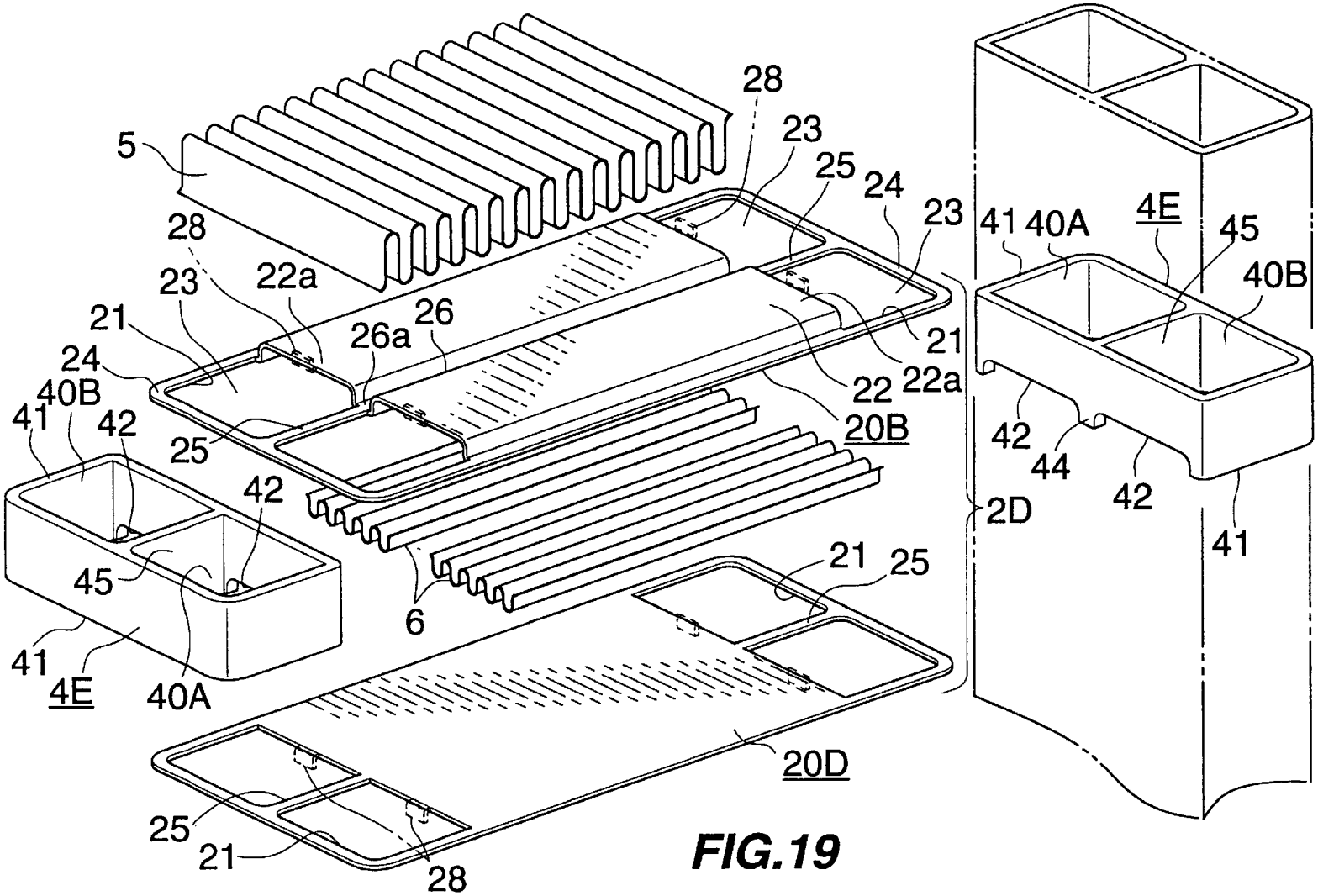
FIG. 19 is an exploded perspective view showing on an enlarged scale one unit of a composite cooler according to a fifth embodiment.

This embodiment is an application of the present invention to a composite cooler which comprises an air-cooled oil cooler and an air-cooled after cooler in combination for industrial devices such as compressors, and is shown in FIG. 19.

This composite cooler has the same construction as the second embodiment, i.e., the composite cooler 12, shown in FIGS. 12 to 15 as the first embodiment with the exception of the following features.

This composite cooler comprises compressed air-oil channel members 2D each comprising an upper first plate 20B having the same construction as the plate 20B shown in FIGS. 12 to 14, and a flat lower second plate 20D having a fluid passing holes 21 at each of opposite lateral ends thereof, with the end hole 21 divided into front and rear two portions by a striplike partition 25 extending longitudinally of the plate. These plates are joined with the recessed surface of the channel portion 22 of the first plate 20B down to form the channel member 2D.

Header members 4E each interposed between each pair of adjacent compressed air-coil channel members 2D at each of opposite lateral ends of the cooler have the same construction as the end header member 4B of the composite cooler 12 according to the second embodiment. The header member 4E has an upper face which comprises a flat portion 41 to be fitted to the peripheral edge portion of the second plate 20D defining the end hole 21 thereof. The upper end face of the header member 4E is joined to the hole-defining peripheral edge portion of the second plate 20D opposed thereto. The lower end face of the header member 4E is joined to the peripheral edge portion of the first plate 20B opposed thereto and defining an opening 23 formed by the end hole 21 of the first plate 20B and the open end of the channel portion 22 thereof for communication with the header member 4E. Each of the upper and lower end faces of the vertical partition wall 45 of the header member 4E is joined to the striplike partition 25 of the second or first plate 20D or 20B opposed thereto, and the protruding partition 44 of the recessed portion 42 in the lower end face of the header member 4E is joined to the recessed end of the ridgelike partition 26 of the first plate 20B opposed thereto.

In the case of this composite cooler, the second plate 20D need not be formed with the channel portion 22. Of the upper and lower end faces of the header member 4E, only the lower end face to be opposed to the first plate 20B needs to be worked on to form a recess portion 42. Accordingly, the number of working steps can be correspondingly decreased to achieve improved productivity.

Although not shown, the first plate 20B and the second plate 20D of the fifth embodiment described may each have a vertical wall 27 extending longitudinally thereof along each of front and rear edges the plate between the corresponding pair of laterally opposed header members 4E so as to be in contact with outer surfaces of the opposed header members 4E for determining the inward position of the opposed header members. Further as indicated in chain lines in FIG. 19, the channel portion 22 of the first plate 20B and the inner portion of the second plate 20C defining the opposite end holes 21 may each be formed at opposite ends thereof with respective vertical walls 28 extending transversely of the plate so as to be in contact with inner surfaces of the corresponding pair of laterally opposed header members 4E for determining the outward position of the opposed header members.

Like the plate 20B shown in FIG. 16, the first plate 20B of the fifth embodiment may be formed, along the edge defining each of the left and right holes 21, with a slanting wall 29 integral with the flat portion 24 and the channel portion 22 and to be positioned at an acute angle with the inner surface of the header member 4E. With the fifth embodiment, the slanting wall 29 makes an acute angle also with the surface of the vertical partition wall 45 and is integral with the striplike partition 25.

INDUSTRIAL APPLICABILITY

The heat exchangers of the present invention are useful as air-cooled oil coolers or air-cooled after coolers for various industrial devices, or as composite coolers comprising an air-cooled oil cooler and an air-cooled after cooler in combination for industrial devices such as compressors.

What is claimed is:

1. A heat exchanger comprising a plurality of fluid channel members arranged one above another in parallel at a spacing and each composed of a pair of plates, each of the plates having a fluid passing hole at each of opposite lateral ends thereof and a channel portion extending over the entire length thereof between the end holes for forming a fluid channel, the pair of plates being joined with recessed surfaces of their channel portions opposed to each other to form the fluid channel member; and annular header members each interposed between each pair of adjacent fluid channel members at each of opposite lateral ends of the heat exchanger, each of the header members having upper and lower end faces each comprising a flat portion to be fitted to a flat portion of an edge of each plate defining the end hole thereof and a recessed portion to be fitted to a protuberant end face of the plate channel portion, the upper and lower end faces of each of the header members at each of the opposite lateral ends of the exchanger being joined to a peripheral edge portion of the plate immediately adjacent thereto and defining an opening formed by the end hole of the plate and an open end of the channel portion thereof for communication with the header member to form a header at each of the opposite lateral ends.

2. A heat exchanger according to claim 1 wherein at least one of the opposite end holes of each plate is divided into front and rear portions by a striplike partition extending laterally, the channel portion of the plate being divided into front and rear portions by a ridgelike partition projecting in the form of a reverse channel toward a recessed side of the channel portion and having a top wall extending laterally so as to be integral with the striplike partition, the header members at least one of the opposite lateral ends of the exchanger each having a hollow portion divided into front and rear portions by a vertical partition wall corresponding to the striplike partition of the plate, the recessed portion in each of the upper and lower end faces of each header member with the vertical partition wall being divided into front and rear portions by a protruding partition fittable to a recessed end of the ridgelike partition of the plate, each of upper and lower end faces of the vertical partition wall being joined to the striplike partition of the plate opposed thereto, the protruding partition of the recessed portion in the end face of the header member being joined to the recessed end of the ridgelike partition of the plate opposed thereto.

3. A heat exchanger comprising a plurality of fluid channel members arranged one above another in parallel at a spacing and each composed of a first plate and a second plate, the first plate having a fluid passing hole at each of opposite lateral ends thereof and a channel portion extending over the entire length thereof between the end holes for forming a fluid channel, the second plate having a fluid passing hole at each of opposite lateral ends thereof, the plates being joined with a recessed surface of the channel portion of the first plate opposed to the second plate to form the fluid channel member; and annular header members each interposed between each pair of adjacent fluid channel members at each of opposite lateral ends of the heat exchanger, each the header members having upper and lower end faces one of which comprises a flat portion to be fitted to a peripheral edge portion of the second plate defining the end hole thereof, the other end face comprising a flat portion to be fitted to a flat portion of an edge of the first plate defining the end hole thereof and a recessed portion to be fitted to a protuberant end face of the channel portion of the first plate, one of the upper and lower end faces of each of the header members at each of the opposite lateral ends of the exchanger being joined to the hole-defining peripheral edge portion of the second plate opposed thereto, the other end face being joined to a peripheral edge portion of the first plate opposed thereto and defining an opening formed by the end hole of the first plate and an open end of the channel portion thereof for communication with the header member to form a header at each of the opposite lateral ends.

4. A heat exchanger according to claim 3 wherein at least one of the opposite end holes of the first plate is divided into front and rear portions by a striplike partition extending laterally, the channel portion of the first plate being divided into front and rear portions by a ridgelike partition projecting in the form of a reverse channel toward a recessed side of the channel portion and having a top wall extending laterally so as to be integral with the striplike partition, at least one of the opposite end holes of the second plate being divided into front and rear portions by a striplike partition corresponding to the striplike partition of the first plate, the header members at at least one of the opposite lateral ends of the exchanger each having a hollow portion divided into front and rear portions by a vertical partition wall corresponding to the striplike partition of the plate, the recessed portion in one of the upper and lower end faces of each header member with the vertical partition wall being divided into front and rear portions by a protruding partition fittable to a recessed end of the ridgelike partition of the plate, each of upper and lower end faces of the vertical partition wall being joined to the striplike partition of the plate opposed thereto, the protruding partition of the recessed portion in the end face of the header member being joined to the recessed end of the ridgelike partition of the plate opposed thereto.

5. A heat exchanger according to claim 1 or 3 wherein a piping socket communication bore is formed across at least two adjacent header members of the header at least one of the opposite lateral ends of the exchanger, with one end of at least one pair of plates of the fluid channel member positioned in the socket communication bore.

6. A heat exchanger according to claim 1 or 3 wherein the pair of plates forming the fluid channel member each have a vertical wall extending longitudinally thereof along each of front and rear edges of the plate between the corresponding pair of laterally opposed header members so as to be in contact with outer surfaces of the opposed header members for determining the inward position of the opposed header members.

7. A heat exchanger according to claim 1 or 3 wherein the channel portion of each of the pair of plates constituting the fluid channel member is formed at opposite ends thereof with respective vertical walls extending transversely of the plate so as to be in contact with inner surfaces of the corresponding pair of laterally opposed header members for determining the outward position of the opposed header members.

8. A heat exchanger according to claim 6 wherein the channel portion of each of the pair of plates constituting the fluid channel member is formed at opposite ends thereof with respective vertical walls extending transversely of the plate so as to be in contact with inner surfaces of the corresponding pair of laterally opposed header members for determining the outward position of the opposed header members.

9. A heat exchanger according to claim 3 wherein the channel portion of the first plate and an inner portion of the second plate defining the opposite end holes are each formed at opposite ends thereof with respective vertical walls extending transversely of the plate so as to be in contact with inner surfaces of the corresponding pair of laterally opposed header members for determining the outward position of the opposed header members.

10. A heat exchanger according to claim 3 wherein the first plate and the second plate forming the fluid channel member each have a vertical wall extending longitudinally thereof along each of front and rear edges of the plate between the corresponding pair of laterally opposed header members so as to be in contact with outer surfaces of the opposed header members for determining the inward position of the opposed header members, and the channel portion of the first plate and an inner portion of the second plate defining the opposite end holes are each formed at opposite ends thereof with respective vertical walls extending transversely of the plate so as to be in contact with inner surfaces of the corresponding pair of laterally opposed header members for determining the outward position of the opposed header members.

11. A heat exchanger according to claim 1 wherein the pair of plates constituting the fluid channel member are each formed, along an edge thereof defining each of the opposite end holes, with a slanting wall positioned at an acute angle with an inner surface of the header member and integral with the flat portion and the channel portion.

12. A heat exchanger according to claim 2 wherein the pair of plates constituting the fluid channel member are each formed, along an edge thereof defining the end hole having the striplike partition, with a slanting wall positioned at an acute angle with an inner surface of the header member and an inner surface of the vertical partition wall and integral with the flat portion, the striplike partition and the channel portion.

13. A heat exchanger according to claim 3 wherein the first plate is formed, along an edge thereof defining each of the opposite end holes, with a slanting wall positioned at an acute angle with an inner surface of the header member and integral with the flat portion and the channel portion.

14. A heat exchanger according to claim 4 wherein the first plate is formed, along an edge thereof defining the end hole having the striplike partition, with a slanting wall positioned at an acute angle with an inner surface of the header member and an inner surface of the vertical partition wall and integral with the flat portion, the striplike partition and the channel portion.

* * * * *